US006751915B2

(12) United States Patent
Crowley

(10) Patent No.: US 6,751,915 B2
(45) **Date of Patent: *Jun. 22, 2004**

(54) KITS AND SYSTEMS RELEASABLY ATTACHABLE TO A WALL, AND METHODS EMPLOYING SAME

(75) Inventor: John S. Crowley, Falmouth, ME (US)

(73) Assignee: New England Classic Interiors, Inc., South Portland, ME (US)

( * ) Notice: Subject to any disclaimer, the term of this patent is extended or adjusted under 35 U.S.C. 154(b) by 52 days.

This patent is subject to a terminal disclaimer.

(21) Appl. No.: 10/058,982

(22) Filed: Jan. 28, 2002

(65) Prior Publication Data

US 2002/0166303 A1 Nov. 14, 2002

Related U.S. Application Data

(63) Continuation-in-part of application No. 09/640,980, filed on Aug. 17, 2000, now Pat. No. 6,341,461, which is a continuation of application No. 08/781,056, filed on Jan. 9, 1997, now abandoned, application No. 10/058,982, which is a continuation-in-part of application No. 09/605,251, filed on Jun. 18, 2000, now Pat. No. 6,374,562.

(51) Int. Cl.[7] ..... E04B 2/00; E04B 2/08; E04F 13/10

(52) U.S. Cl. ..... 52/311.2; 52/506.05; 52/DIG. 13; 52/211; 52/717.01; 52/718.01; 52/313; 52/511

(58) Field of Search ..... 52/DIG. 13, 506.05, 52/287.1, 288.1, 211, 204.53, 717.01, 718.01, 313, 511, 716.1, 311.2, 579

(56) References Cited

U.S. PATENT DOCUMENTS

| | | | | | |
|---|---|---|---|---|---|
| 741,524 | A | | 10/1903 | Miller | |
| 2,594,928 | A | | 4/1952 | Horowitz | 20/4 |
| 3,616,120 | A | | 10/1971 | Warwick | 428/81 |
| 3,668,808 | A | * | 6/1972 | Perina | |
| 3,745,709 | A | * | 7/1973 | Perina | |
| 3,863,412 | A | * | 2/1975 | Bodycomb et al. | 52/483.1 |
| 3,981,112 | A | | 9/1976 | Dake | 52/184 |
| 4,041,667 | A | * | 8/1977 | Lindner et al. | |
| 4,271,566 | A | * | 6/1981 | Perina | |
| 4,557,096 | A | | 12/1985 | Hovde | 52/595 |
| 4,724,638 | A | | 2/1988 | Bezborodko | 52/311 |
| 4,736,559 | A | | 4/1988 | Young | 52/313 |

(List continued on next page.)

FOREIGN PATENT DOCUMENTS

| | | | | |
|---|---|---|---|---|
| CH | 134020 | | 11/1929 | 52/506.01 |
| DE | 100 58 853 A1 | * | 5/2002 | E04F/13/08 |

OTHER PUBLICATIONS

Stair–Pak, Panel–Pak Wainscoting, Stair–Pak Products Co., Inc., Sold Since 1989, 4 pages.

(List continued on next page.)

*Primary Examiner*—Robert Canfield
(74) *Attorney, Agent, or Firm*—Heslin Rothenberg Farley & Mesiti P.C.

(57) ABSTRACT

A kit releasably attachable to a wall includes a plurality of elongated members, and at least one hook-and-loop fastener. The plurality of members are releasably attachable to the wall with the at least one hook-and-loop fastener to define at least one frame. For example, the kit may be elongated members for framing a door or a window. The kit may also include at least one panel to be framed such as a raised panel, a cork board, a chalkboard, and a presentation board. At least one resilient shim may be positionable between the wall and a rear portion of the at least one panel. In another embodiment, the kit includes an upper rail, a bottom rail, a plurality of stiles, a plurality of raised panels, and at least one hook-and-loop fastener for releasably attaching the rails to the wall.

64 Claims, 14 Drawing Sheets

U.S. PATENT DOCUMENTS

| | | | | | |
|---|---|---|---|---|---|
| 4,744,189 | A | * | 5/1988 | Wilson | 52/511 |
| 4,845,910 | A | * | 7/1989 | Hanson et al. | 52/288.1 |
| 5,056,283 | A | | 10/1991 | Sapinski | 52/184 |
| 5,144,786 | A | * | 9/1992 | Pacione | 52/511 X |
| 5,526,857 | A | | 6/1996 | Forman | 144/346 |
| 5,623,800 | A | | 4/1997 | Shinkosky | 52/468 |
| 5,860,260 | A | | 1/1999 | Hase | 52/307 |
| 5,884,444 | A | | 3/1999 | Harris | 52/311.2 |
| 5,894,701 | A | | 4/1999 | Delorme | 52/801.11 |
| 5,941,046 | A | * | 8/1999 | Prather | 52/717.01 |
| 6,173,542 | B1 | * | 1/2001 | Wright | 52/211 |
| 6,341,461 | B1 | * | 1/2002 | Crowley et al. | 52/311.2 |
| 6,374,562 | B1 | * | 4/2002 | Crowly | 52/560.01 |

OTHER PUBLICATIONS

Contract Joinery, Ken Austin, pp. 79–84, First U.S. Publication Aug. 1988.

Cabinet Factory, "Where Custom Made Quality Begins," Cabinet Factory, Inc., 1983, 4 pages.

The Hyde Park Raised Panel System, The Return of Elegance at an Affordable Price, Hyde Park Lumber Company, 1989, 5 pages.

Mid–America Building Products, A Tapco International Company. The Mid–America Master Series, 1997, 4 pages.

How To Install Plywood Wall Paneling, Georgia–Pacific Corporation, 1993, 2 pages.

How To Install Panelboard Wall Paneling, Georgia–Pacific Corporation, 1993, 2 pages.

SelecTrim Panelling System, The James Wood Company, Feb. 24, 1993, 3 pages.

"The Cost of Solid Wood Raised Panels Is Ridiculous!!!", American Panels, May/Jun. 1993, 2 pages.

Miscellaneous Millworks, Woodharbor, 1996, pp. MM1–MM4.

Estate Winscotting Library Systems, Mantlecraft, Inc., Mar. 1995, 4 pages.

New England Classic Raised Panel System, New England Classic Interiors, 1996, Booklet and Installation Guide, pp. 1–15.

New England Classic Raised Panel System, Brochure describing features, benefits, installation, parts, etc. (1997).

Crowley, pending U.S. patent application Ser. No. 09/605,251, filed Jun. 28, 2000, entitled Adjustably Sizeable Raised Panel System For Stairs and Methods For Forming And Installing Same.

Crowley et al., U.S. patent application Ser. No. 09/640,980, filed Aug. 17, 2000, entitled "Modular Wall Pantel System," now U.S. patent No. 6,341,461, issued Jan. 29, 2002.

* cited by examiner

KITS AND SYSTEMS RELEASABLY ATTACHABLE TO A WALL, AND METHODS EMPLOYING SAME

RELATED APPLICATIONS

This application is a continuation-in-part of U.S. patent application Ser. No. 09/640,980, filed Aug. 17, 2000, entitled "Modular Wall Panel System" and issued as U.S. Pat. No. 6,341,461, which was a continuation of U.S. patent application Ser. No. 08/781,056, filed Jan. 9, 1997, now abandoned entitled "Modular Wall Panel System" now abandoned. This application is also a continuation-in-part of U.S. patent application Ser. No. 09/605,251, filed Jun. 18, 2000, Entitled "Adjustably Sizeable Raised Panel System for Stairs and Method for Forming and Installing Same," issued as U.S. Pat. No. 6,374,562. The entirety of these applications and patents are incorporated herein by reference.

TECHNICAL FIELD

This invention relates kits and systems attachable to a wall. More particularly, the invention relates to kits and systems which are releasably attachable to a wall.

BACKGROUND ART

A decorative wall panel system such as wainscoting include a top horizontal rail, a lower horizontal rail, and a plurality of alternating rectangularly-shaped stiles and raised panels disposed between the rails. The system is typically installed over a horizontally-extending, lower portion of a wall of a room.

The rails, stiles, and raised panels are often custom-made and installed by highly skilled carpenters. In addition, the rails, stiles, and raised panels are generally permanently fastened to the wall using nails, screws, z-clips, and/or adhesives.

There is a need for further wall panel systems.

SUMMARY OF THE INVENTION

The present invention provides, in a first aspect, a kit releasably attachable to a wall. The kit includes a plurality of elongated members, at least one hook-and-loop fastener, and the plurality of members are releasably attachable to the wall with the at least one hook-and-loop fastener to define at least one frame. The kit may include elongated members for framing a door or a window. The kit may also include at least one panel to be framed such as a raised panel, a cork board, a chalkboard, and a presentation board. At least one resilient shim may be positionable between the wall and a rear portion of the at least one panel.

The present invention provides, in a second aspect, a kit for forming a raised panel system releasably attachable to a wall. The kit includes an upper rail having an upper L-shaped groove, a bottom rail having a lower L-shaped groove, and a plurality of stiles having an upper tongue, a lower tongue, and side L-shaped grooves, a plurality of raised panels, and at least one hook-and-loop fastener. The upper tongue is sandwichable between a surface of the upper L-shaped groove and the wall, and the lower tongue is sandwichable between a surface of the lower L-shaped groove and the wall. The tongue of the plurality of raised panels is sandwichable between a surface of the upper L-shaped groove of the upper rail, a surface of the lower L-shaped groove of the bottom rail, and a surface of the side L-shaped grooves of the stiles. A plurality of resilient shims may be positionable between the wall and a rear portion of the plurality of panels.

The present invention provides, in a third aspect, a kit for forming a raised panel system releasably attachable to a wall along a flight of stairs. The kit an upper rail, a bottom rail, and a plurality of stiles, a plurality of adjustably sizeable raised panels, and at least one hook-and-loop fastener. The plurality of adjustably sizeable raised panels comprise a parallelogram-shaped member having a pair of vertically-extending sides, and generally parallel angled top and bottom side, and an outer frame having a relieved portion and a peripherally-extending portion. The peripherally-extending portion of the pair of vertically-extending sides includes a first length and the peripherally-extending portion of the top and the bottom sides comprising a second length. The second length is greater than the first length.

In other aspects of the present invention, systems releasably attachable to the wall and methods for decorating a wall are also described.

BRIEF DESCRIPTION OF THE DRAWINGS

The subject matter which is regarded as the invention is particularly pointed out and distinctly claimed in the claims at the conclusion of the specification. The features and advantages of the invention will be apparent from the following detailed description taken in conjunction with the accompanying drawings, which drawings illustrate several embodiments of the invention.

DETAILED DESCRIPTION OF THE INVENTION

The various disclosed embodiments in accordance with the present invention provide systems, e.g., decorative framing, boards, wall panels, wainscoting, are releasably attachable to a wall. Such systems which may be manufactured and sold in kits which allow residential and non-residential consumers to decorate the wall of their homes and business. Providing releasably attachable components overcomes the reluctance by customers to purchase conventional interior wall decor which is typically custom-made to the room requiring fabrication and installation by highly skilled carpenters, and which is generally permanently attached to the wall resulting in damage to the wall and the various components. The present invention also provides releasably attachable components can be removed and reused in other locations.

Figure 1:
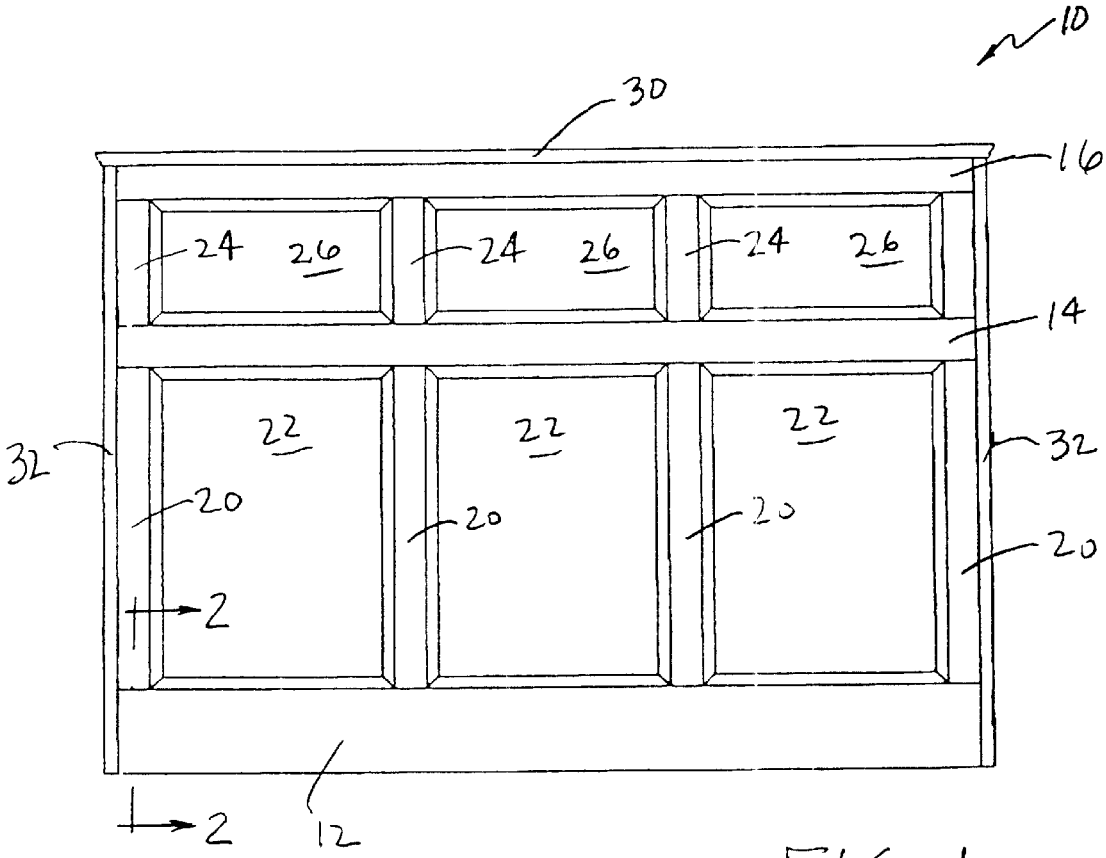
FIG. 1 is a front elevational view of one embodiment of a system releasably attachable to a wall in accordance with the present invention.

FIG. 1 illustrates one embodiment of a releasably attachable system 10 in accordance with the present invention. In this illustrated embodiment, system 10 includes elongated members such as a bottom rail 12, a middle rail 14, a top rail 16, a plurality of alternating stiles 20 and raised panels 22 disposed between bottom rail 12 and middle rail 14, a plurality of alternating stiles 24 and raised panels 26 disposed between middle rail 14 and top rail 16, a top cap 30 and side caps 32.

In addition, system 10 includes means for releasably attaching the various decorative components to the surface of the wall. For example, a plurality of hook-and-loop fasteners may be used to releasably attach the various components to the surface of the wall, which is described in greater detail below.

Figure 2:
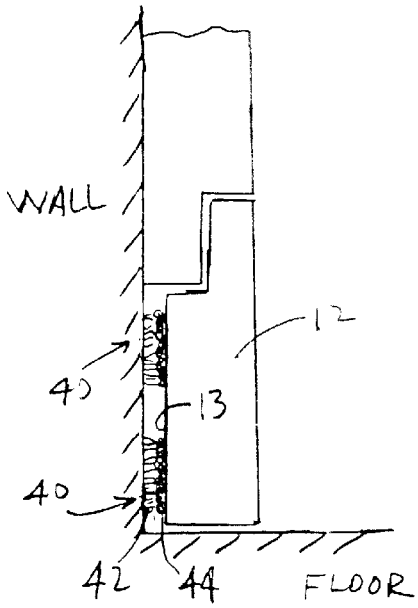
FIG. 2 is a cross-sectional view taken along line 2—2 in FIG. 2.

FIG. 2 illustrates in greater detail the releasable attachment of bottom rail 12 to the wall. For example, one or more strips of hook-and-loop fastener 40 include a hook portion 42 having a backing which is attached to the wall, and a loop portion 44 having a backing which is attached to a rear surface 13 of bottom rail 12.

Figure 3:
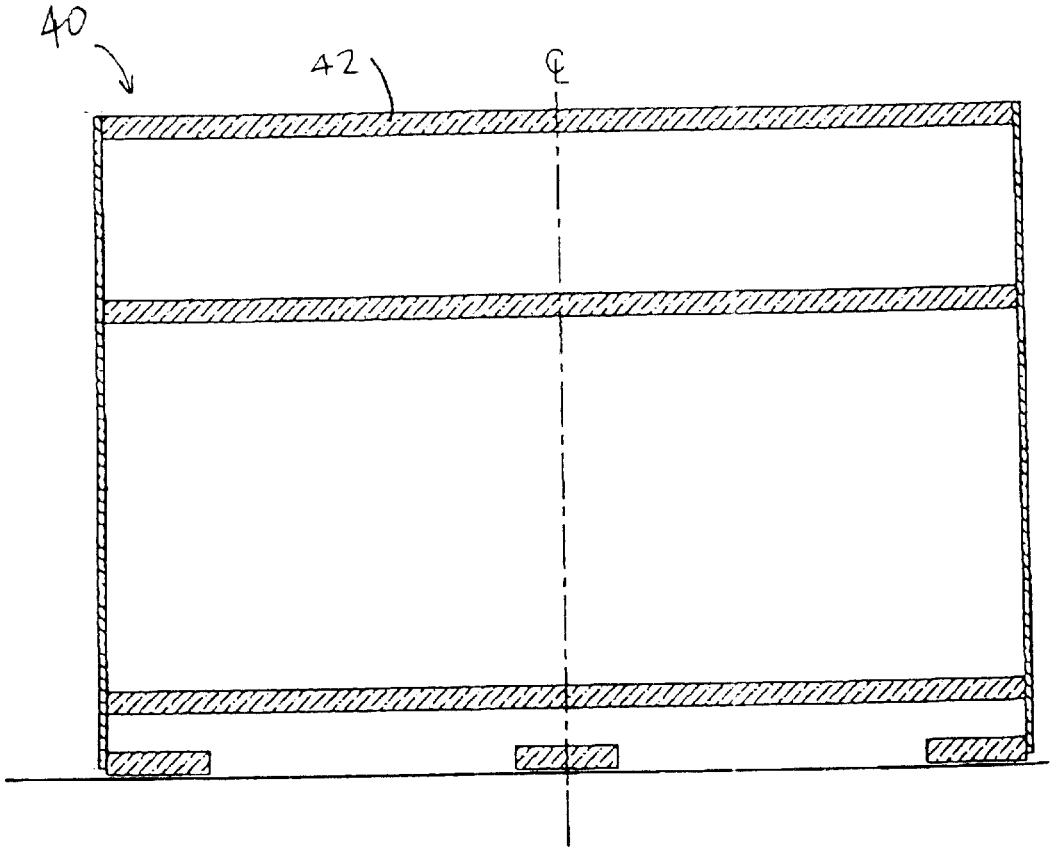
FIG. 3 is a front elevational view, similar to FIG. 1, illustrating a portion of the hook-and-loop fastener attached to the wall for releasably attaching the various decorative components of the system shown in FIG. 1.

With reference to FIGS. 1 and 3, a plurality of strips of look portions 42 of the strips of hook-and loop fastener 40 may be attached to the wall which correspond to the length of the top rail, the middle rail, the bottom rail, the side caps, and the top cap. Corresponding loop portions (not shown) may be attached to the rear surfaces of the top rail, the middle rail, the bottom rail, the side caps, and the top cap for releasably attaching the various components to the hook portions on the wall. The panels and stiles need not include hook-and-loop fasteners, but instead may be releasably attached to the wall by being sandwiched between portions of the bottom rail, the middle rail, the top rail, the stiles, and the side caps.

Figure 4:
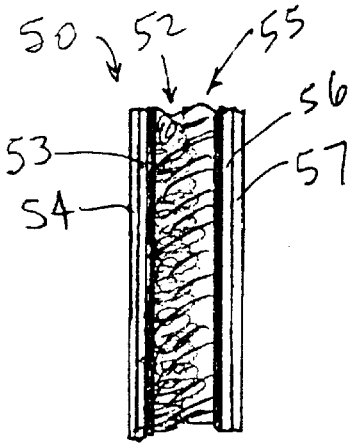
FIG. 4 is a cross-sectional view of a hook-and-loop fastener strip.

The strip of hook-and-loop fastener may be configured in one or more rolls and supplied to the user with the purchase of the various components as a kit. As shown in FIG. 4, the roll of hook-and-loop fastener 50 may include a hook portion 52 having a backing having a layer of adhesive 53 and a protective release cover sheet 54, and a loop portion 55 having a backing having a layer of adhesive 56 and a protective release cover sheet 57. In installing the system, a user would attach one of the portions of the hook-and-loop fastener to the required rear surfaces of the various components before of after cutting the various components, if needed.

Figure 5:
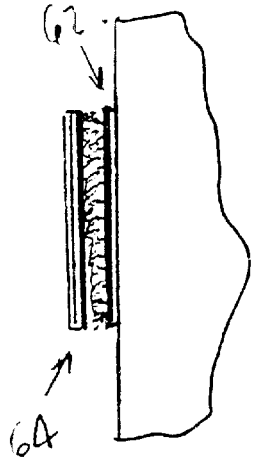
FIG. 5 is a cross-sectional view of a hook-and-loop fastener strip, a portion of which is attached to a component and the other portion having a layer of adhesive and a protective release cover.

Alternatively, as shown in FIG. 5, one of the portions 62 of the hook-and-look fasteners may be attached to the rear surface of the various components by a manufacturer. The other portion 64 may include a layer of adhesive and a protective release cover sheet. Suitable hook-and-loop fasteners may include hook-and-loop fasteners manufactured and sold by Velcro Industries, part number VELCRO Knit Loop 3905 0115, and part number VELCRO HTH Hook 830 0115. As used herein the term hook-and loop fasteners is meant to means VELCRO-type fasteners or other releasable mechanical interlocking-type fasteners. The hook-and-loop fastener for the rails may include a 2-inch wide strip, the hook-and-loop fastener for the caps may include a ⅝-inch or ¾-inch wide strip.

Releasably attachable system 10 may be modular and prefabricated by a manufacture and sold as a kit. For example, the kit may include standard sized rails, stiles, panels, caps, and bases. Alternatively, a customer may select from various standard sized components based on the dimension of the wall to be decorated. The various components may also be provided and require limited cutting by the user to conform to components to the wall to be decorated.

Whether the releasably attachable means is attached by a user or the manufacture, the components may be releasably attached to the wall by removing the release cover sheet and using hand pressure install the components by working upwardly to install the rails, panels, stiles, etc., until the top most component is releasably attached in place.

Figure 6:
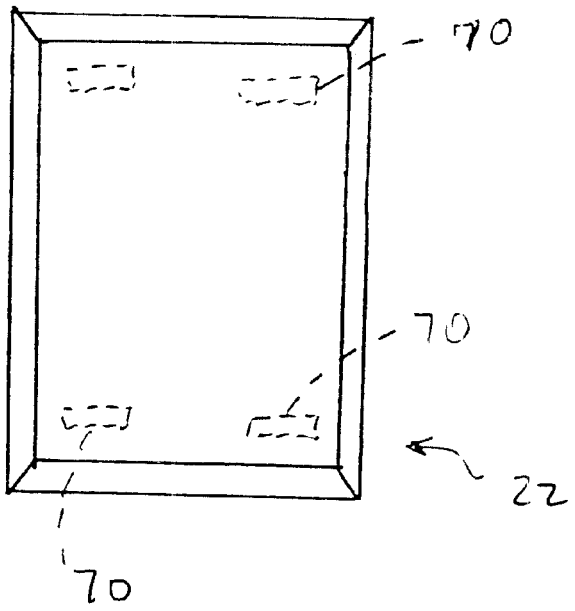
FIG. 6 is a front elevation view of the raised panel shown in FIG. 1 to which hook-and-look fastener strips (shown in dashed lines) are attached to the rear surface of the raised panel.
Figure 7:
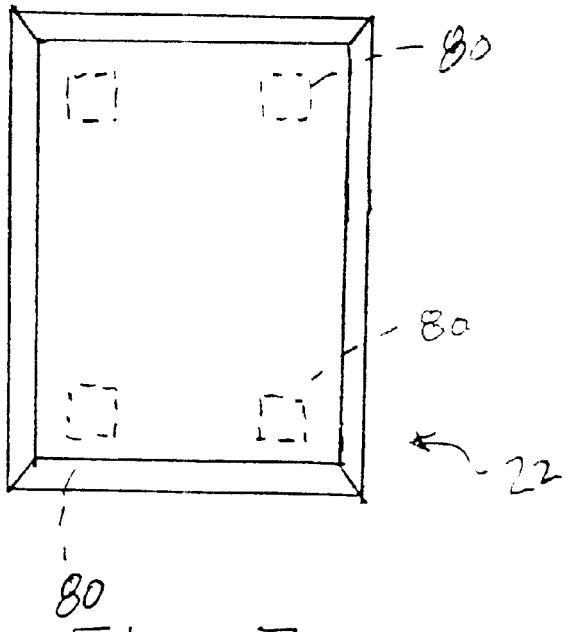
FIG. 7 is a front elevation view of the raised panel shown in FIG. 1 to which resilient shims (shown in dashed lines) are attached to the rear surface of the raised panel.

With reference to FIG. 6, raised panel 22 may include at least one, and for example, four hook-and-loop fastener strips 70 disposed adjacent to a corner of the raised panel. Alternatively, as shown in FIG. 7, raised panel 22 may include at least one foam or resilient shim, and for example, four resilient shims 80 placed or attached behind the panels to provide an outward force for aligning the edges of the panels against the mating edges of the rails and side caps. In a similar manner, resilient shims may be placed behind the stiles. Suitable resilient shims are manufactured and sold by Velcro Industries, part number Fast Tape Rubber Base, which has pressure sensitive adhesive disposed on one side of the tape.

Figure 8:
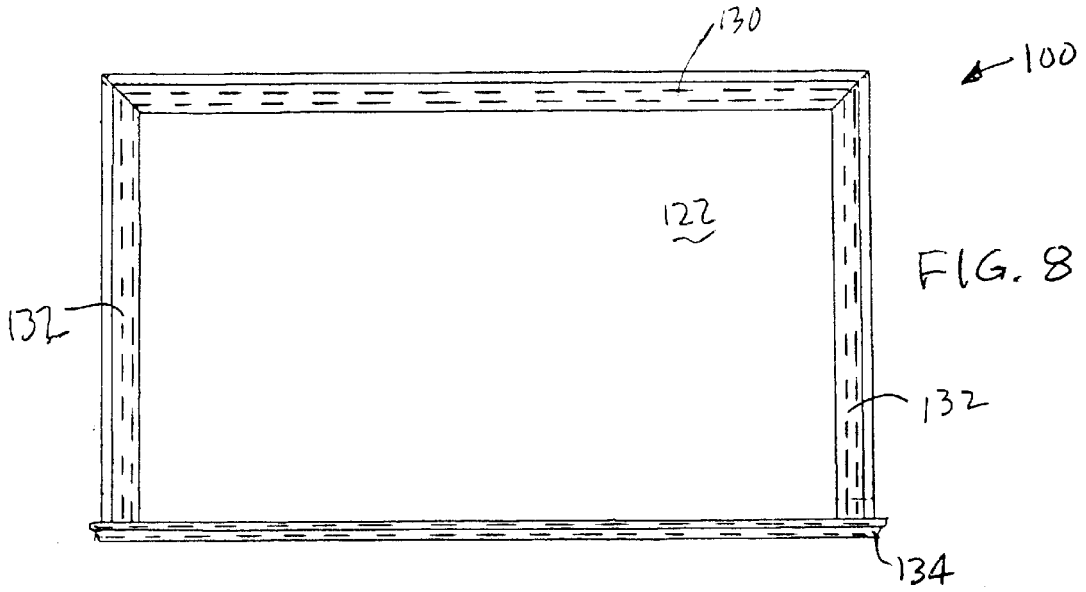
FIG. 8 is a front elevational view of another embodiment of the system releasably attachable to a wall for framing a panel such as a cork board or other resilient material, a chalkboard, and a presentation board in accordance with the invention.
Figure 9:
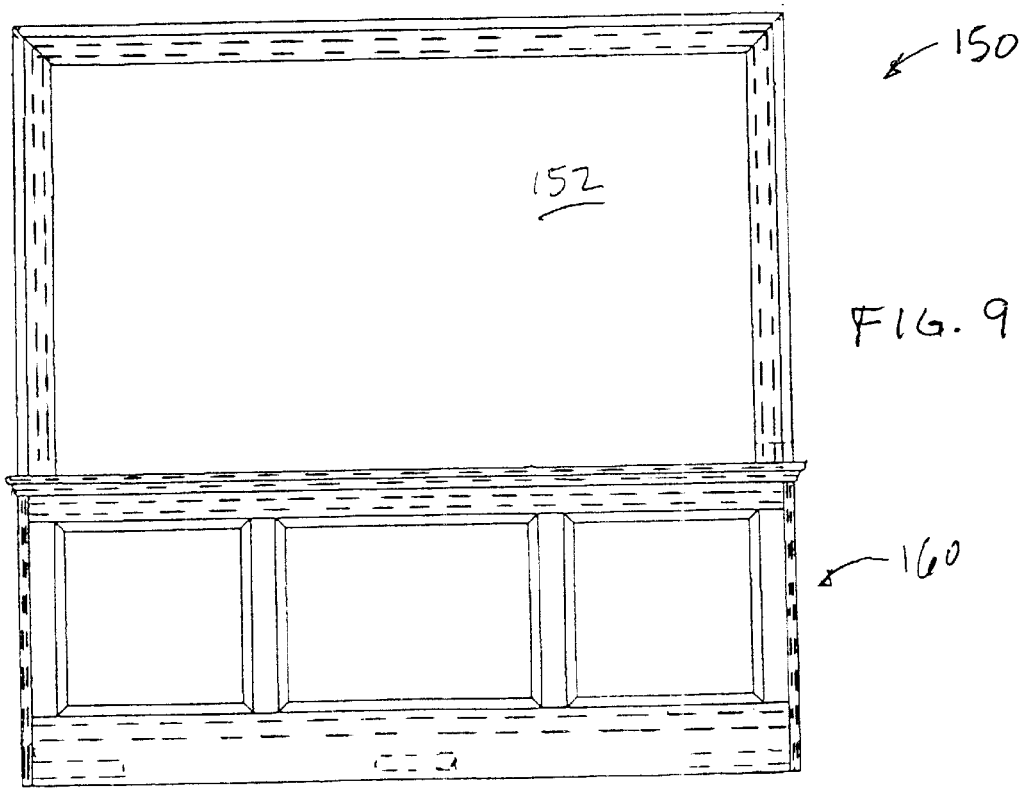
FIG. 9 is a front elevational view of another embodiment of the system releasably attachable to a wall for framing a panel such as a cork board or other resilient material, a chalkboard, and a presentation board, and which includes a lower paneled portion in accordance with the invention.

FIG. 8 illustrates a further system 100 in accordance with the present invention for framing a panel 122 such as a cork board or other resilient material, a chalkboard, and a presentation board, e.g., a dry erase board, releasably attached to a wall. For example, four elongated members, e.g., a top molding 130, side moldings 132, and a bottom molding 134 may be provided for framing the cork board, the chalkboard, or the presentation board. Suitable hook-and-loop fasteners (shown in dashed lines) may be used, as described above, for releasable attaching the various components to the wall. FIG. 9 illustrates another system 150 in accordance with the present invention for framing a panel 152 such as a cork board or other resilient material, a chalkboard, and a presentation board, e.g., a dry erase board, releasably attached to a wall, and which also includes a releasably attached lower paneled portion 160 as generally described above.

Figure 10:
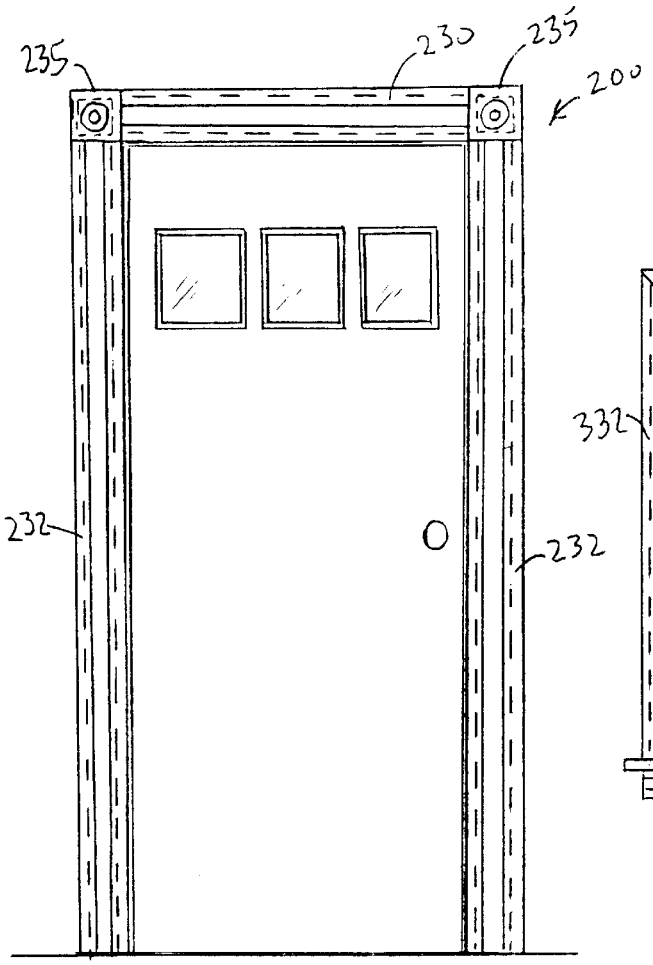
FIG. 10 is a front elevational view of another embodiment of a system releasably attachable to a wall for framing a door in accordance with the invention.

FIG. 10 illustrates another system 200 releasably attachable to a wall in accordance with the present invention for decoratively framing the opening of a door. For example, three elongated members, e.g., top molding 230 and side moldings 232, may be provided for decoratively outlining the opening of the door. Releasably attachable corner pieces 235 may also provide additional accents. Suitable hook-and-loop fasteners (shown in dashed lines) may be used, as described above, for releasable attaching the various components to the wall around the door.

Figure 11:
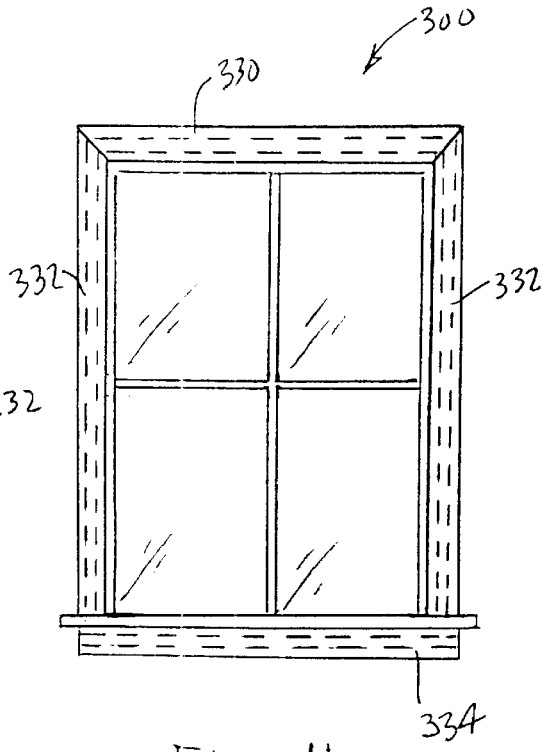
FIG. 11 is a front elevational view of another embodiment of a system releasably attachable to a wall for framing a window in accordance with the invention.

FIG. 11 illustrates another releasably attachable system 300 releasably attachable to a wall in accordance with the present invention for decoratively framing a window. For example, four elongated members, e.g., top molding 330, side moldings 323, and a bottom molding 334 may be provided for outlining the opening of the window. Suitable hook-and-loop fasteners may be used, as described above, for releasable attaching the various components to the wall around the window.

Figure 12:
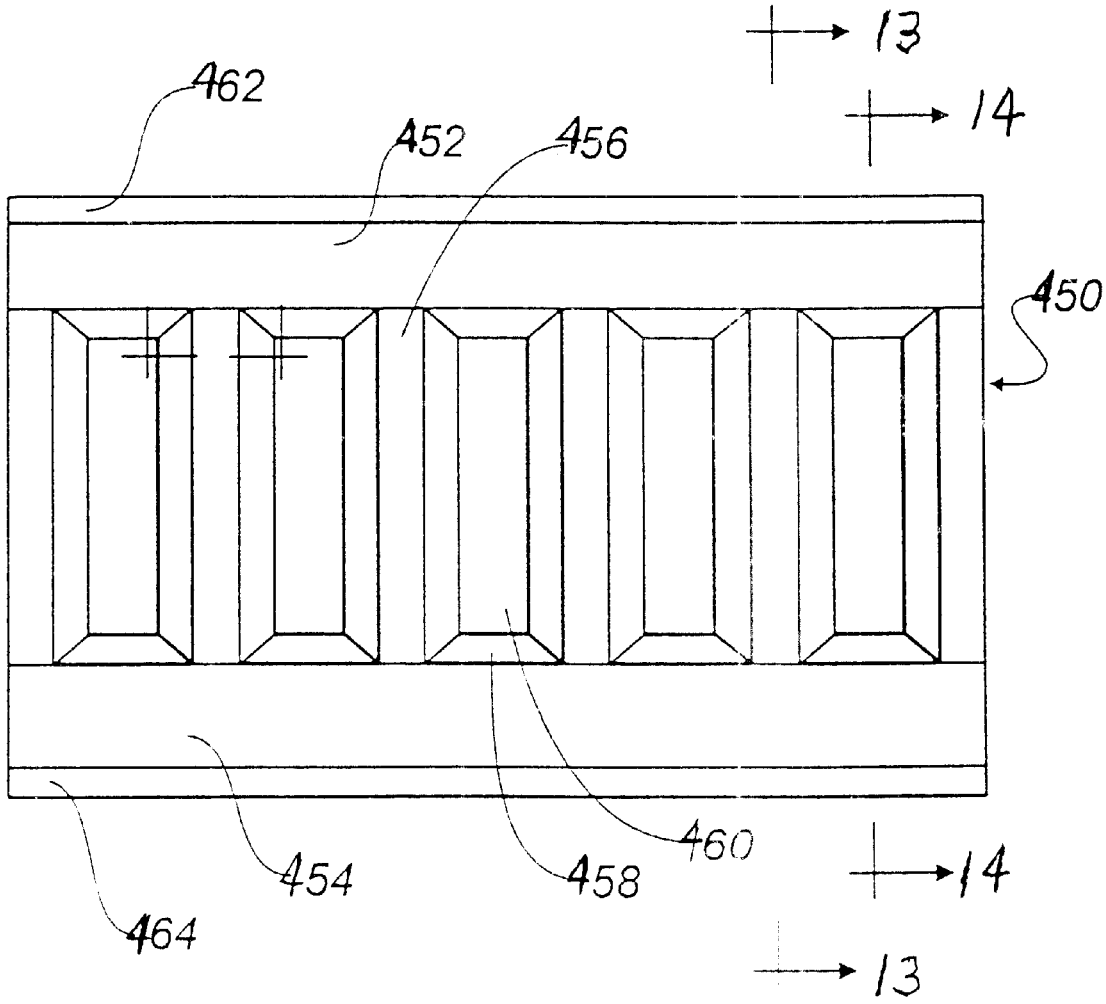
FIG. 12 is an elevational view of another embodiment of a modular raised wall panel system releasably attachable to a wall in accordance with the present invention.
Figure 13:
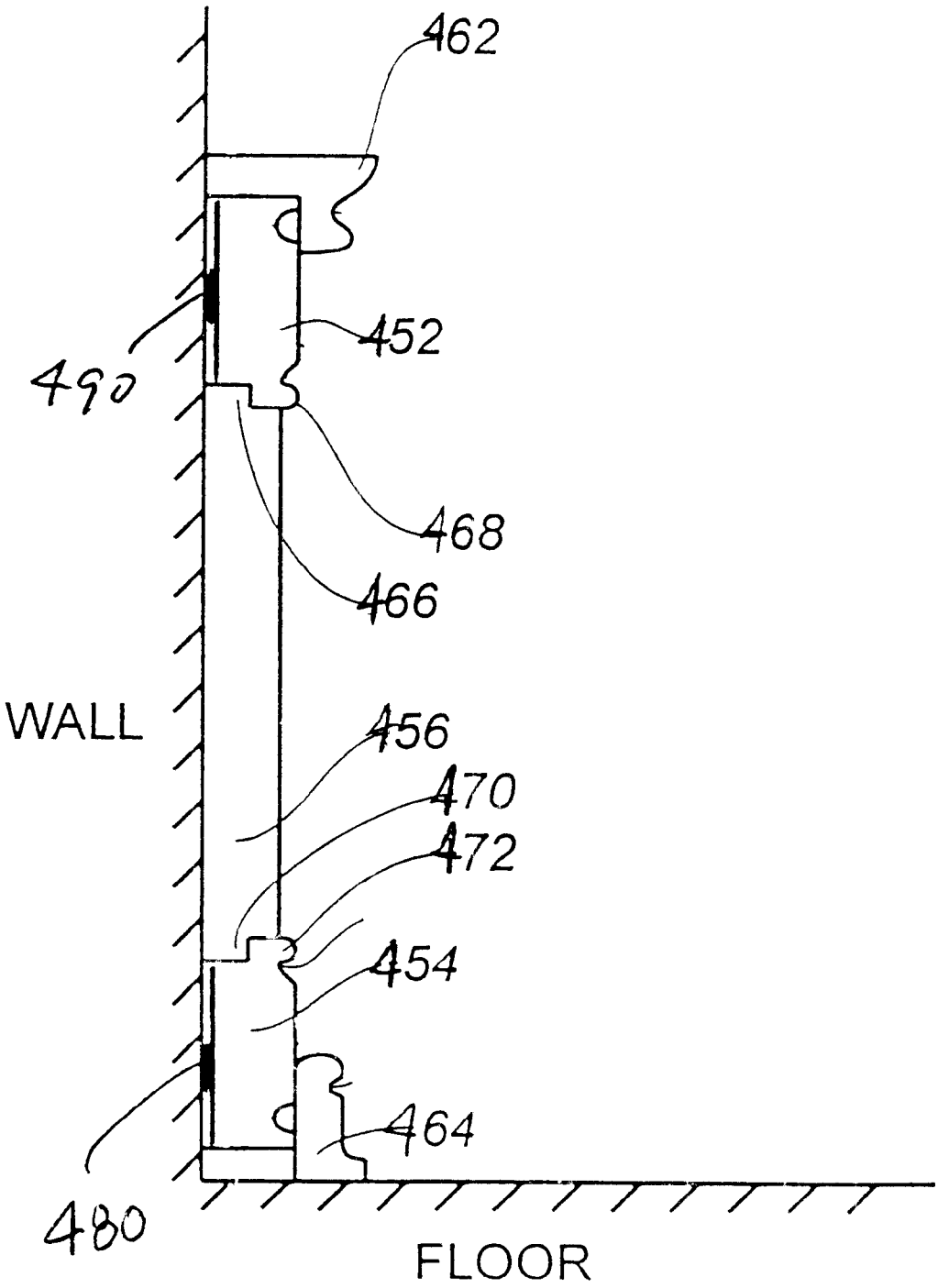
FIG. 13 is a cross-sectional view of the system taken along line 13—13 of FIG. 12.
Figure 14:
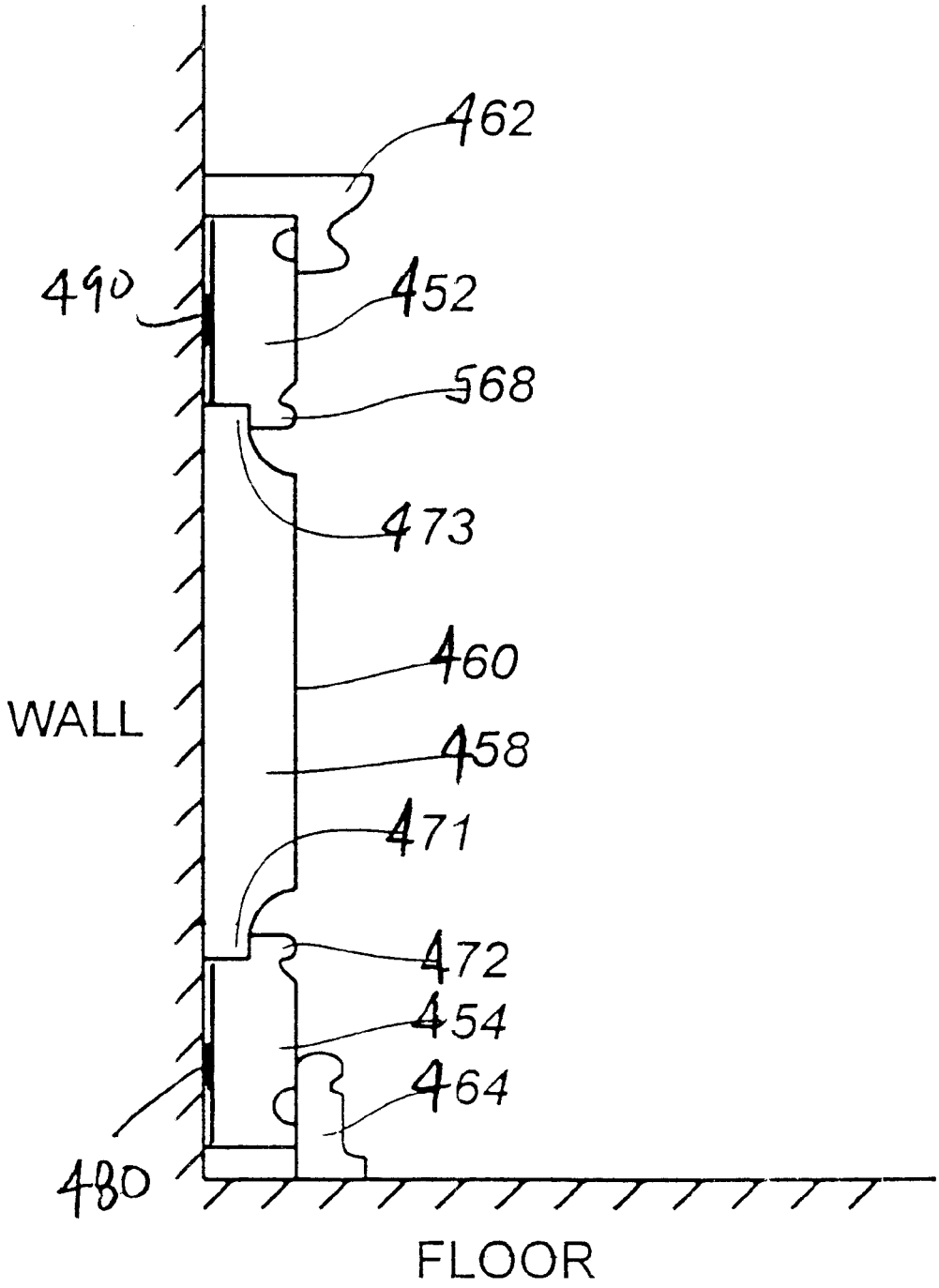
FIG. 14 is a cross-sectional view of the system taken along line 14—14 of FIG. 12.

FIGS. 12–14 illustrate another embodiment of a system 450 releasably attachable to a wall in accordance with the present invention. System 450 includes decorative components similar to the components described in U.S. patent application Ser. No. 09/640,980, entitled "Modular Wall Panel System," issued as U.S. Pat. No. 6,341,461, the entire subject matter of which is incorporated herein by reference.

As shown in FIG. 12, for example, system 450 includes a top rail 452, a lower rail 454, a plurality of stiles 456, a plurality of panels 458 with raised portions 460, a cap 462, and a base shoe 464. As shown in FIG. 13, top rail 452 has a lip 468 lip defining an L-shaped groove, and lower rail 454 has a lip 472 defining an L-shaped groove. Stiles 456 have an upper tongue portion 466 that fits between lip 468 in top rail 452 and the wall, and a lower tongue portion 470 that fits between lip 472 in lower rail 454 and the wall. As shown in FIG. 14, panels 460 have an upper tongue portion 473 that fits between lip 468 in top rail 452 and the wall, and a lower tongue portion 471 that fits between lip 472 in lower rail 454 and the wall.

With this arrangement of system 450, coping is not required at the joints between stile 456 (FIGS. 12 and 13) and rails 452 and 454, i.e., stiles 456 (FIGS. 12 and 13) are joined to rails 452 and 454 using noncoped grooves which have simple designs, including straight edges, that do not require the use of a highly skilled artisan to machine or assemble, so a person without advanced skills in wood working can readily prepare and/or assemble these elements of system 450. Moreover, the absence of coped joints allows stiles 456 (FIGS. 12 and 13) to float between rails 452 and 454 and the wall. Hence, unlike traditional wall panel systems, both stiles 456 (FIGS. 12 and 13) and panels 458 (FIGS. 12 and 14) can be moved laterally under lip 472 of lower rail 452 during assembly, making system 450 easier to put together than traditional wall panel systems.

During assembly of system 450, lower rail 454 may be releasably attached to the wall surface by hook-and-loop fastener 480 (FIGS. 13 and 14). Next, tongue portion 470 of stile 456 (FIG. 13) is placed between lip 472 of lower rail 454 and the wall. Similarly, tongue portion 471 of panel 458 (FIG. 14) is placed between lip 472 and the wall (FIG. 14). Stile 456 then is joined with adjacent panels by fitting side tongue portions (not shown) between side lips (not shown), respectively, and the wall. Lip 468 of top rail 452 (FIGS. 13 and 14) is placed above tongue portion 466 of stile 456 and tongue portion 473 of panel 458. Top rail 452 is subsequently attached to the wall surface by hook-and-loop fastener 490 (FIGS. 13 and 14). Cap 462 may also be attached to top rail 452 or wall using hook-and-loop fasteners to the wall. Base shoe 464 is similarly attached to the floor and lower rail 452 using hook-and-loop fasteners. Alternatively, the cap and/or the base shoe may not be attached to the wall, but instead may be attached to the top rail and base shoe, respectively, with an adhesive.

The particular dimensions of the components of releasably attachable system 450 may vary depending upon the intended use. It is envisioned that certain standard dimensions may be used for each component. For example, panels 458 may have a height of about 23 inches, a maximum thickness of about ½ inch, and, when incorporated into system 450, exposed widths of about 6 inches, about 9 inches or about 12 inches. Stiles 456 may have a maximum width of about ½ inches, a height of about 23 inches and, when incorporated into system 450, exposed widths of about 3 or about 10 inches. Top rail 452 and lower rail 454 both have a height of about 4 inches or about 8 inches and a thickness of about ⅝ inches. Cap 462 and base shoe 464 both have a height of about 1¼ inches. Cap 462 is about 1½ inches, and base shoe 464 is about ⅝ inches thick.

Typically, system 450 is assembled to partially or entirely cover a wall surface. It is to be understood, however, that system 450 may be applied to any solid surface, whether it be substantially vertical or horizontal. For example, system 450 can be used to partially or entirely cover the vertical support surface of a bar. Alternatively, system 50 can be used to partially or entirely cover the vertical support surface of a lectern or a podium. It is envisioned that system 450 can be used to cover the lower portion of a wall surface (e.g., the lower third of the wall surface), commonly referred to as wainscoting.

Figure 15:
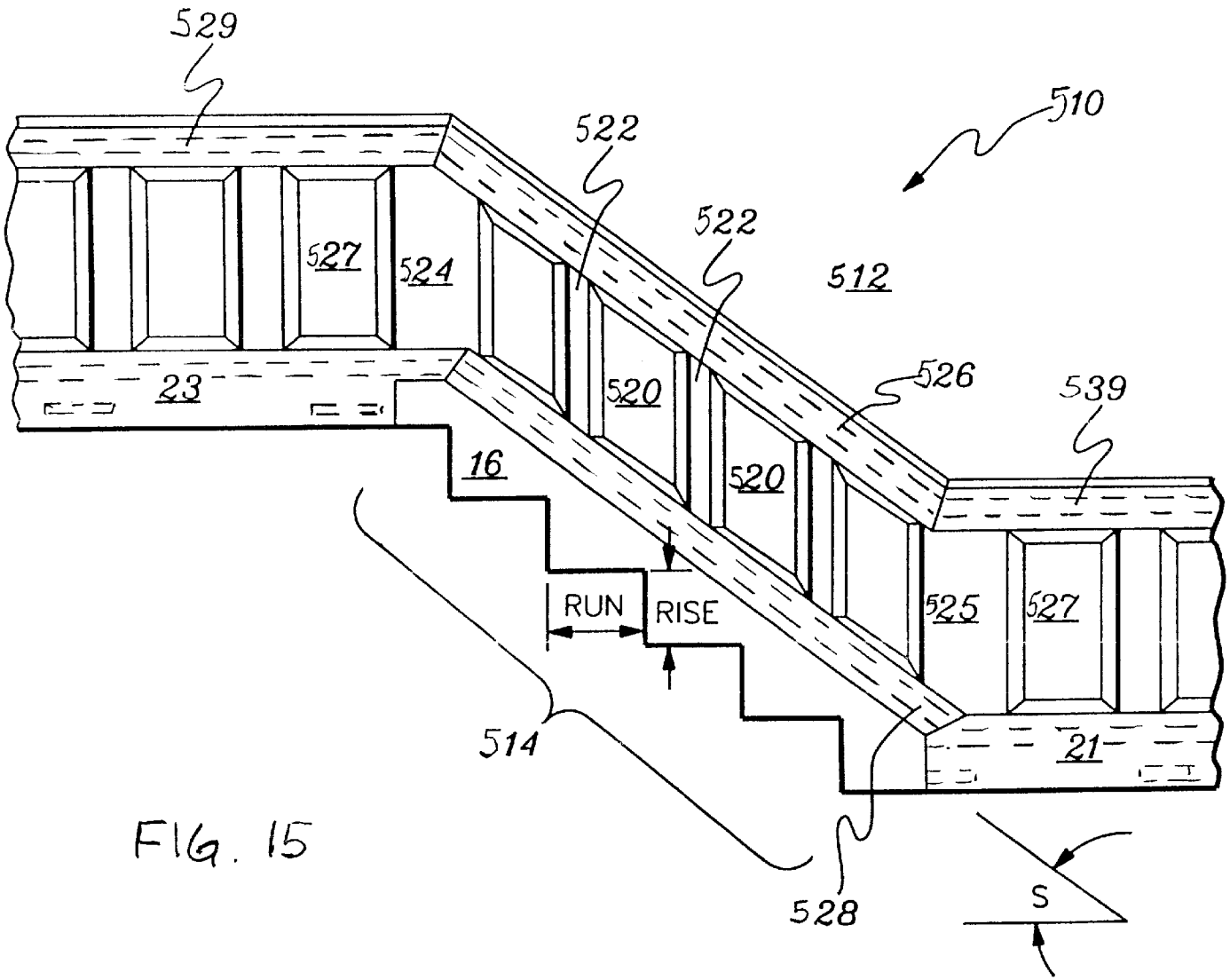
FIG. 15 is a front elevational view of an adjustably sizeable raised panel system releasably attachable along a lower portion of a wall above a flight of stairs in accordance with the present invention.

FIG. 15 illustrates another embodiment of an adjustably sizeable raised panel system 510 (e.g., wainscot) according to the present invention which is releasably attachable to a lower outer surface portion of a wall 512 along a flight of stairs 514. System 510 includes decorative components similar to the components described in U.S. patent application Ser. No. U.S. patent application Ser. No. 09/605,251, filed Jun. 28, 2000, Entitled "Adjustably Sizeable Raised Panel System for Stairs and Method for Forming and Installing Same," issued as U.S. Pat. No. 6,374,562, the entire subject matter of which is incorporated herein by reference. In a similar Manner, the various components may be releasably attached to the wall with hook-and-loop fasteners (shown in dashed line in FIG. 15) as described above.

As explained in greater detail below, the adjustably sizeable raised panel system may be configured to extend along flights of stairs which have a range of or different rises and runs or slopes. The adjustably sizeable raised panel system is desirably readily trimmed by carpenters or homeowners to fit the slopes of common residential and commercial stairs, and is easily installed on the job site using conventional carpentry tools.

In this illustrated embodiment, adjustably sizeable raised panel system 510 includes a plurality of adjustably sizeable raised panels 520, a plurality of stiles 522, top and bottom stair stiles 524 and 525 for transitioning from adjustably sizeable raised panels 520 to horizontally extending rectangular-shaped raised panels 527, a top rail 526, and a bottom rail 528.

Figure 16:
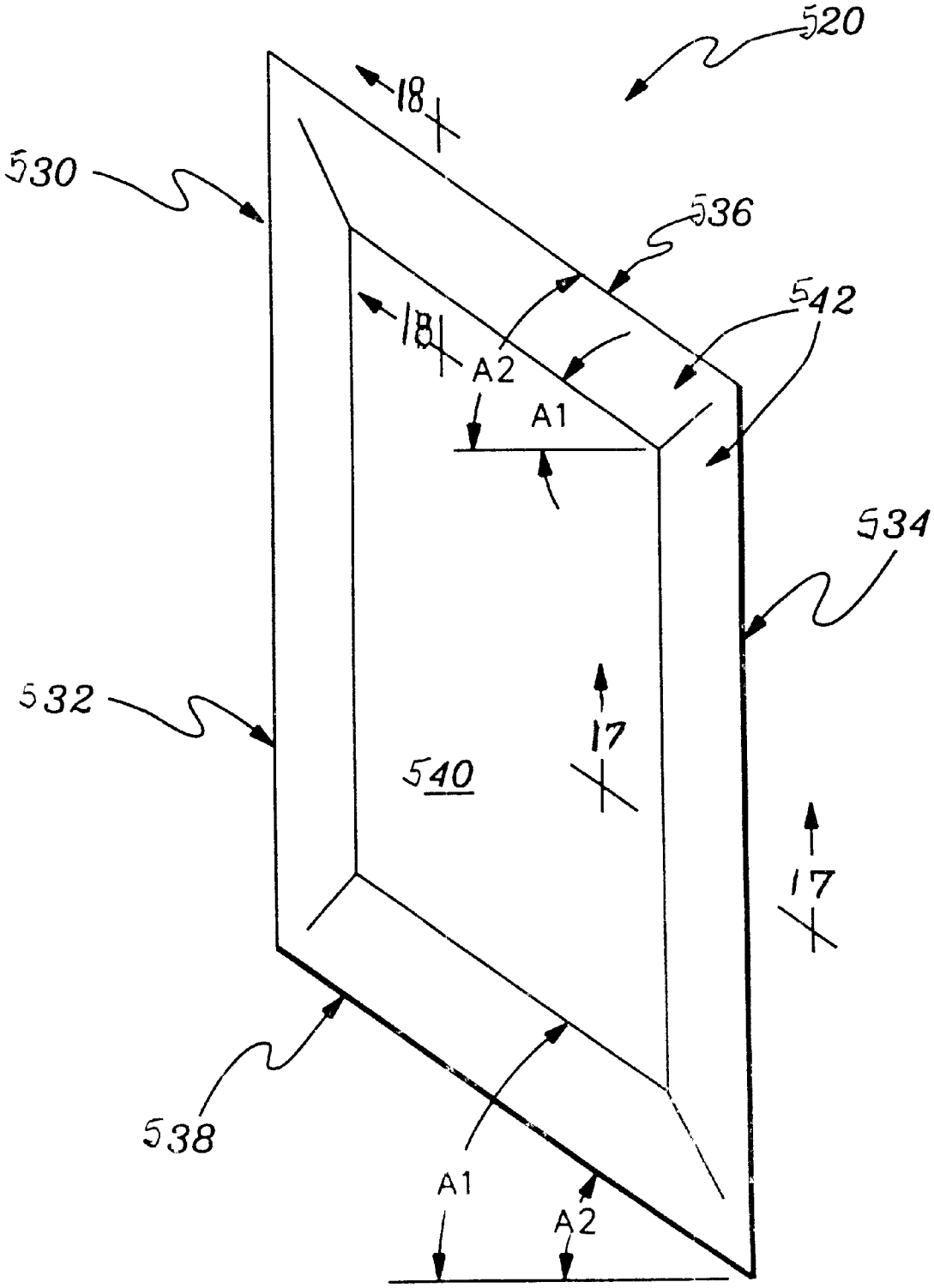
FIG. 16 is an enlarged front elevational view of one of the adjustably sizeable raised panels of FIG. 15.

FIG. 16 illustrates in greater detail, one of the adjustably sizeable raised panels 520. Adjustably sizeable raised panel 520 includes a parallelogram-shaped member 530 having a pair of vertically-extending sides 532 and 534, and generally parallel angled top and bottom sides 536 and 538, respectively. In addition, parallelogram-shaped member 530 includes a central portion 540 and an outer border or frame 542.

Figure 17:
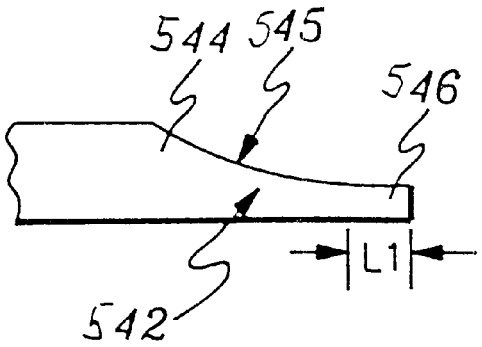
FIG. 17 is a cross-sectional view of a vertically-extending side of the adjustably sizeable raised panel taken along lines 17—17 of FIG. 16.
Figure 18:
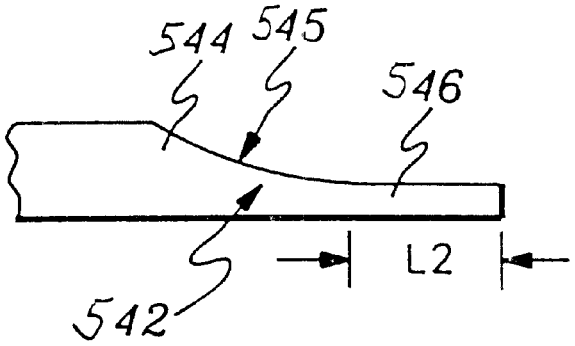
FIG. 18 is a cross-sectional view, rotated ninety degrees clockwise, of the top side of the adjustably sizeable raised panel taken along line 18—18 of FIG. 16.

As best shown in FIGS. 17 and 18, outer frame 542 (FIG. 16) includes a relieved portion 544 and a peripherally-extending portion 546 or tongue for desirably matingly-engaging a top rail, a bottom rail, and a pair of stiles. Peripherally-extending portions 546 of vertically-extending sides 532 and 534 (FIG. 16) have a first length L1 (FIG. 17) and peripherally-extending portions 546 of top and bottom sides 536 and 538 (FIG. 16) have a second length L2. Second length L2 is greater than first length L1 allowing the top and bottom sides to be trimmed to match the slope of the flight of stairs as explained in greater detail below. The length of second length L2 is typically between about ⅛ and ¾ inch greater than first length L1 and desirably at least about ½ inch greater than first length L1.

With reference again to FIG. 15, the rise and run of a flight of stairs of most building code complaint residential stairs range between about 6¾ inches and about 8½ inches for the rise and between about 9 inches and 10¾ inches for the run (not including the nosing or the typically rounded edge of a stair tread that projects over the riser) resulting in a slope S from horizontal of typically between about 35.5 degrees and about 42.5 degrees.

It has been found that the raised panels of the present invention having the relieved portion of top and bottom sides 536 and 538, respectively, disposed on an angle A1 (FIG. 16) of between about 37 degrees from horizontal and about 41 degrees from horizontal allows adjustment, e.g., trimming of the edges of the top and bottom sides, as explained below, to match the slope of about most residential stairs. The distal edge of the top and bottom sides may be disposed on an angle A2 which is desirably the same as A1.

Advantageously, the relieved portion of top and bottom sides 536 and 538, respectively, are disposed on an angle A1 (FIG. 16) of either about 37 degrees from horizontal or about 41 degrees from horizontal which allows adjustment by trimming of the edges of the top and bottom sides of up to plus or minus 1¾ degrees (preferably less than plus or minus 1½ degrees) to match the slope of about most residential stairs without the difference between angle A1 of relieved portions 544 (FIGS. 17 and 18) of the top and bottom sides and the slope S of the flight of the stairs (e.g., the angle of the top and the bottom rail) being visually noticeable to observers.

Commercial building code compliant stairs typically have a slope S of about 30 degrees from horizontal. Raised panels of the present invention for installation along a flight of commercial stairs have the relieved portion of the top and bottom sides 536 and 538, respectively, disposed on an angle A1 (FIG. 16) of about 30 degrees from horizontal to allow adjustment, e.g., trimming of the edges of the top and bottom sides, as explained below, to match the actual slope of the commercial stairs.

Figure 19:
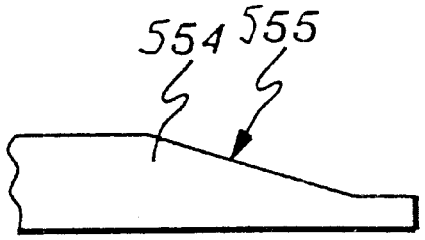
FIGS. 19 and 20 are cross-sectional views of alternative embodiments of the sides of an adjustably sizeable raised panel similar to FIGS. 17 and 18, respectively.
Figure 20:
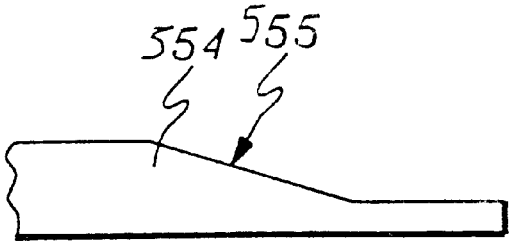
Figure 21:
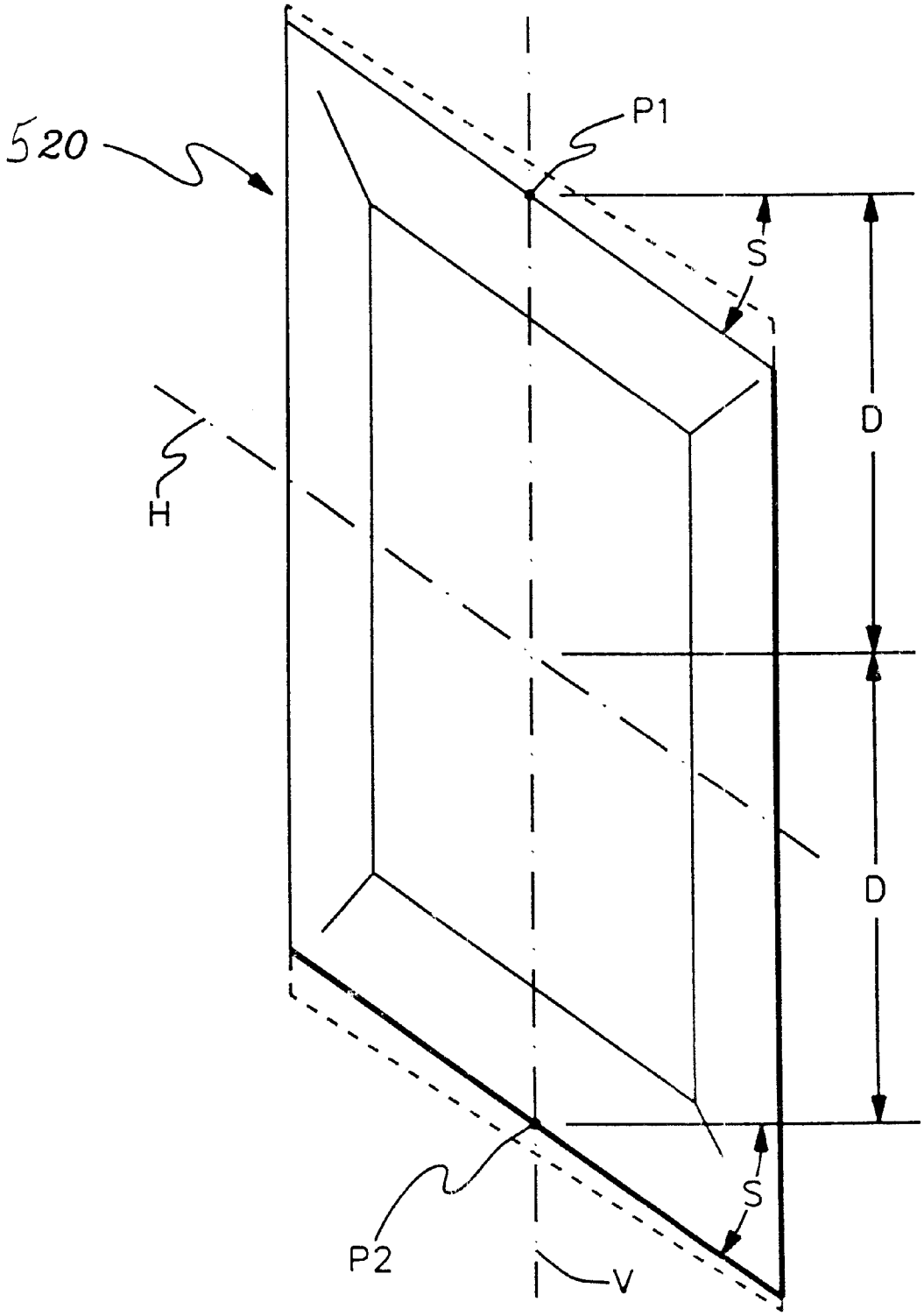
FIG. 21 is a front elevational view illustrating the process for marking and trimming the adjustably sizeable raised panel shown in FIG. 16.

Relieved portion 544, as shown in FIGS. 17 and 18, includes a concave surface 545. Alternatively, as shown in FIGS. 19 and 20, an adjustably raised panel may include a relieved portion 554 having a slanted surface 555. From the present description, it will be appreciated by those skilled in the art that other configurations for the relieved portion would be equally suitable.

FIGS. 21–27 illustrate the process for installing adjustably sizeable raised panel system 510 (FIG. 15). Initially, with reference to FIG. 21, the top and bottom sides of adjustably sizable raised panel 520 are marked and cut to correspond to slope S (FIG. 15) of flight of stairs 514 (FIG. 15). For example, a vertical centerline V and horizontal centerline H or portions thereof are marked on adjustably sizeable raised panel 520. From the intersection of vertical centerline V and horizontal centerline H, points P1 and P2 are marked on vertical centerline V at distance D (typically between about 10 inches and 18 inches) above and below the intersection of vertical centerline V and horizontal centerline H. Through points P1 and P2, lines are drawn at an angle from horizontal corresponding to slope S (FIG. 15) of flight of stairs 514 (FIG. 15) and the outer peripheral edge of the top and the bottom sides of the adjustably sizable raised panel 520 are cut along the drawn lines.

Figure 22:
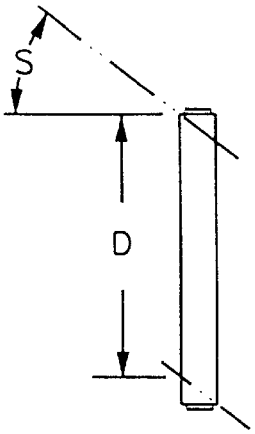
FIGS. 22–24 are front elevational views illustrating the fabrication of a stile.
Figure 23:
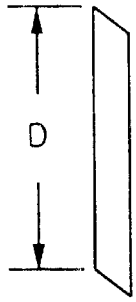
Figure 24:
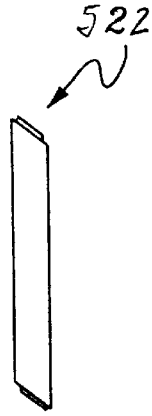

As shown in FIG. 22, spaced-apart lines are drawn at an angle from horizontal corresponding to slope S at a vertical distance D on, for example, a stile for use on a horizontally-extending portion of a raised panel system. The stile is cut along the drawn lines, FIG. 23, and dados are desirably cut in the ends as shown in FIG. 24 to form stile 522.

Figure 25:
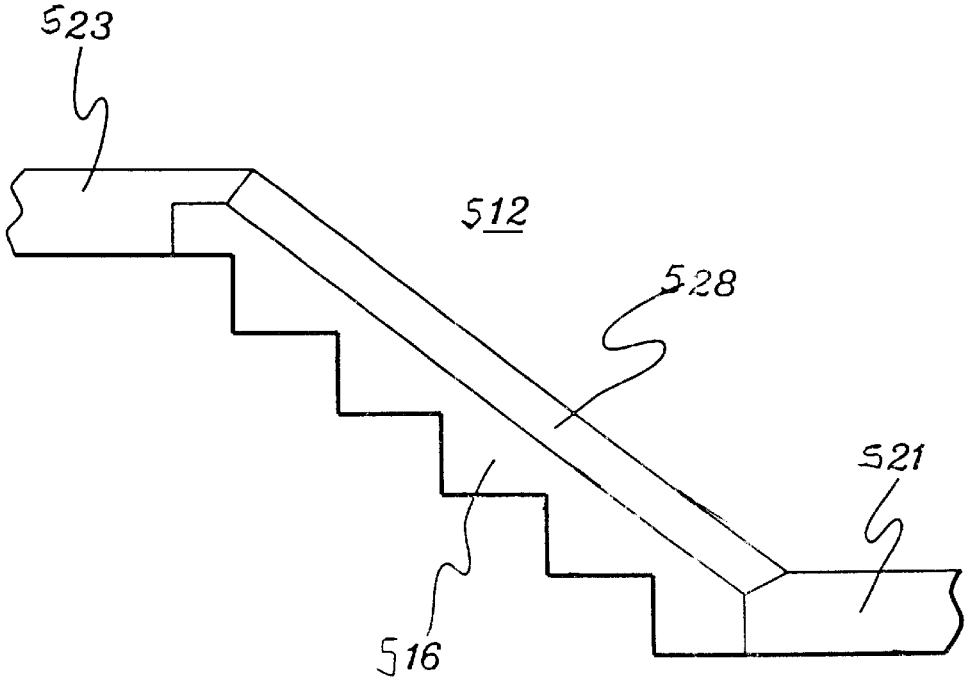
FIGS. 25–27 are front elevational views illustrating the process of installing the adjustably sizable raised panel system of FIG. 15 to the wall along the flight of stairs, and fabrication of the top and bottom stiles.

With reference to FIG. 25, bottom stair rail 528, for example, either a four inch or eight inch wide rail, is fitted to a stair stringer 516 and releasably attached to wall 512 with hook-and-loop fasteners. Horizontal rails 521 and 523 are then cut and fitted to stair stringer 516 and bottom stair rail 528.

Figure 26:
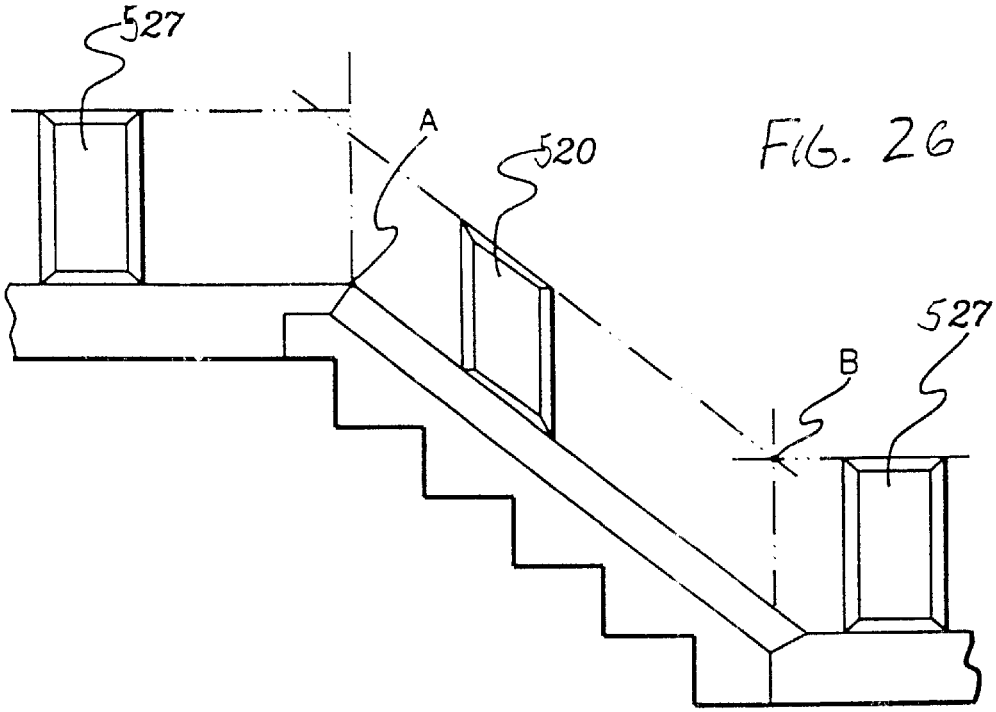

Using the trimmed adjustably sizable raised panels 520 and rectangular-shaped raised panels 527 as guides, as shown in FIG. 26, horizontal and inclined lines are marked on wall 512 corresponding to the upper edges of the raised panels. Next, vertical lines are drawn through a point A and a point B, as shown in FIG. 26, for laying out panels 520 and stiles 522 (FIG. 24) so that there are equal gaps or clearances between the uppermost and lowermost raised panels and the lines through point A and point B.

Figure 27:
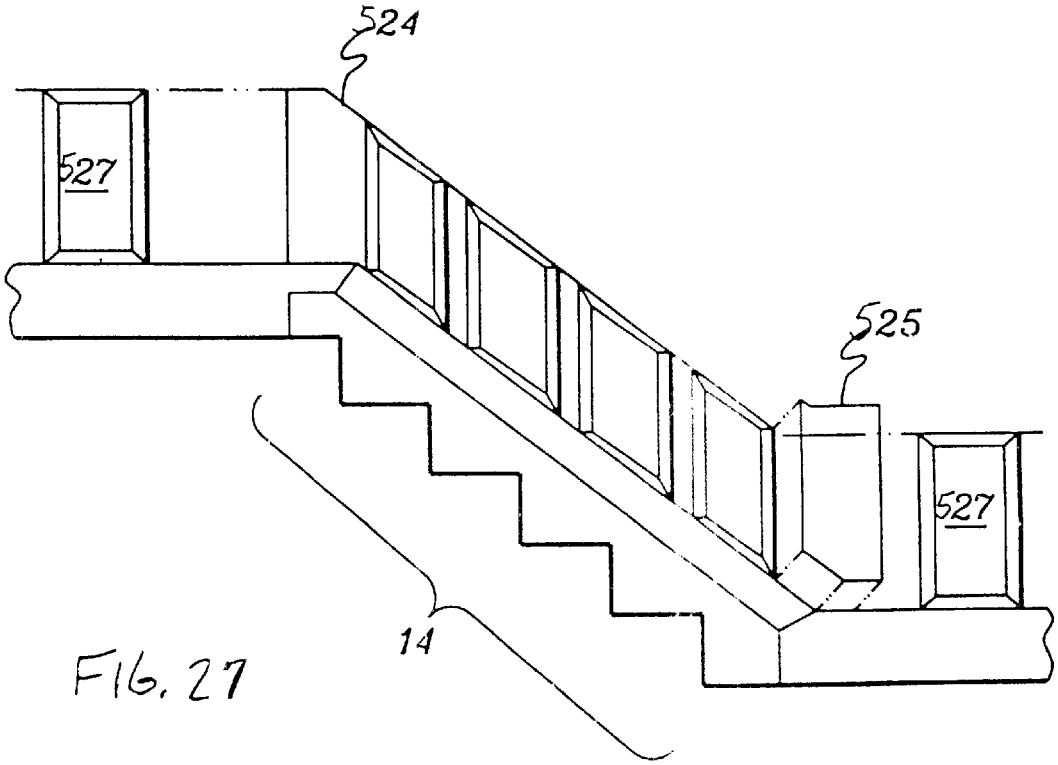
Figure 1:
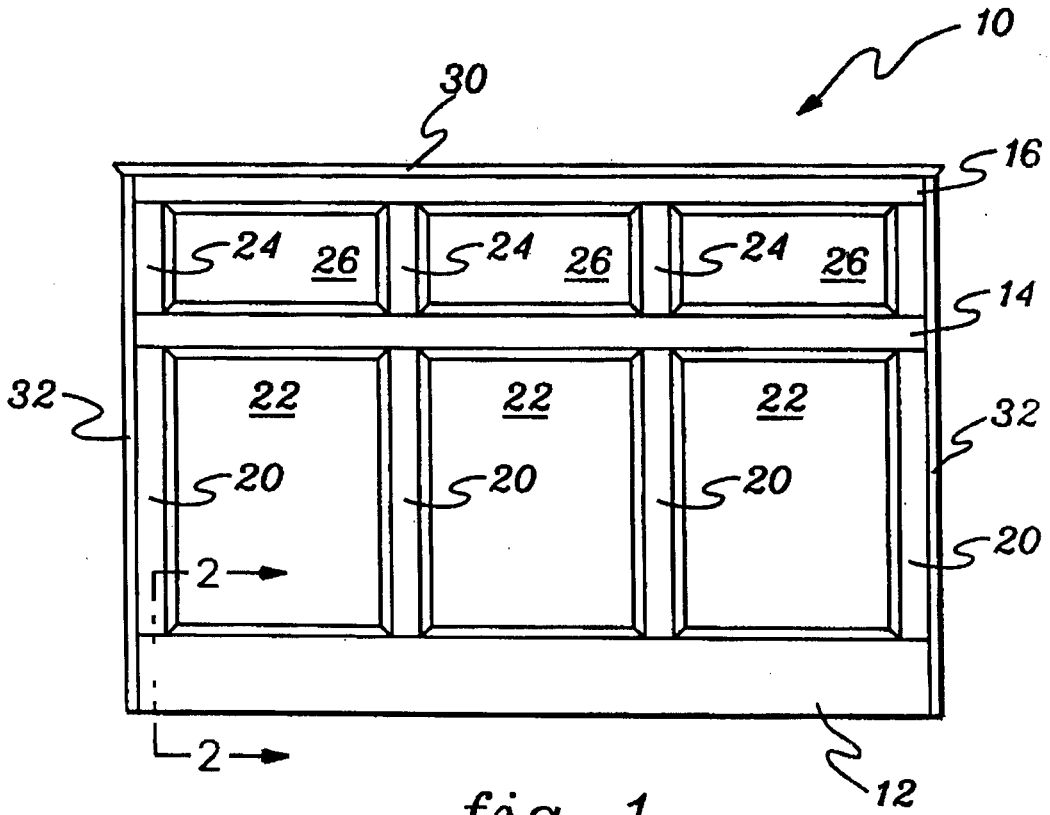
Figure 2:
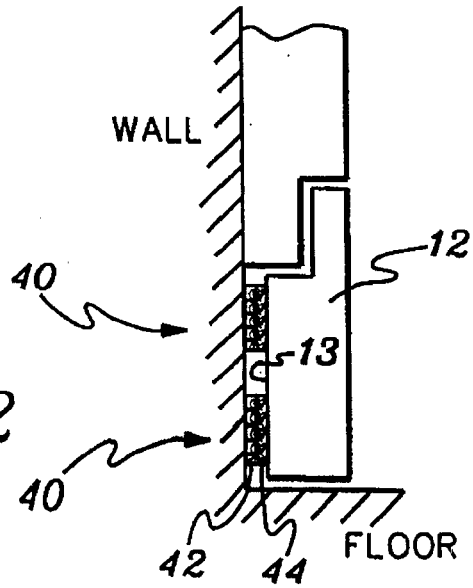
Figure 3:
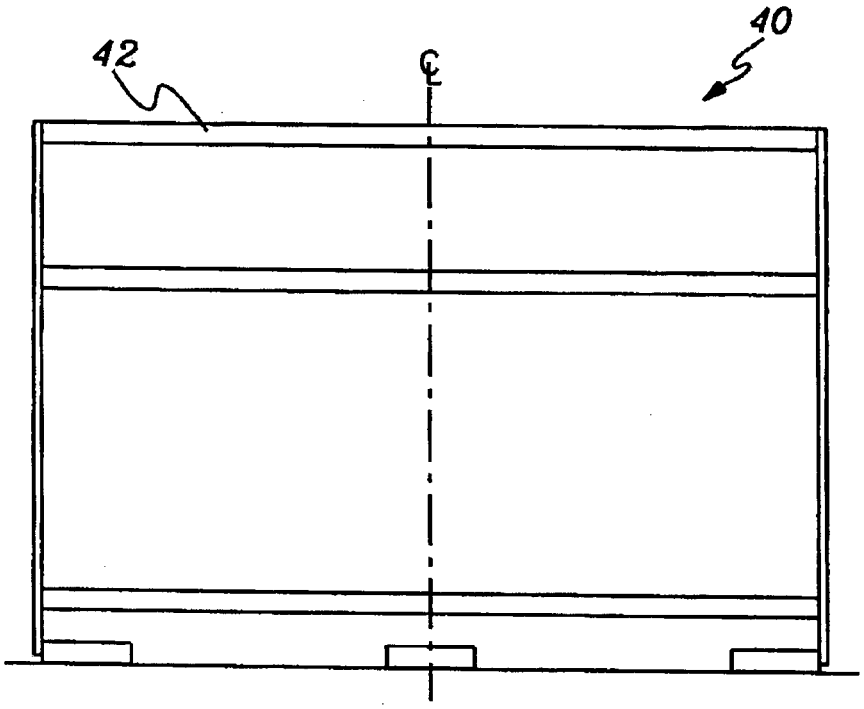
Figure 4:
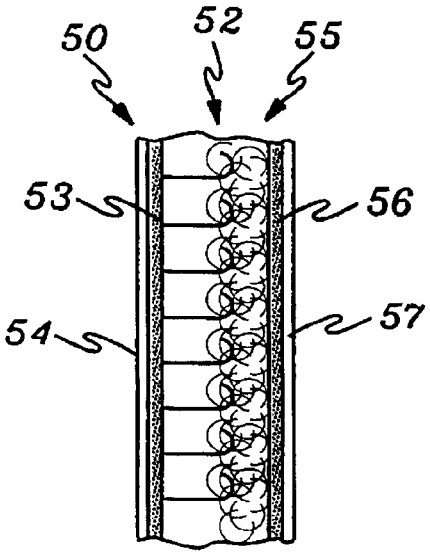
Figure 5:
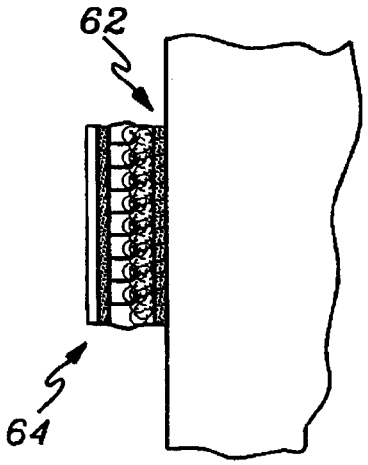
Figure 6:
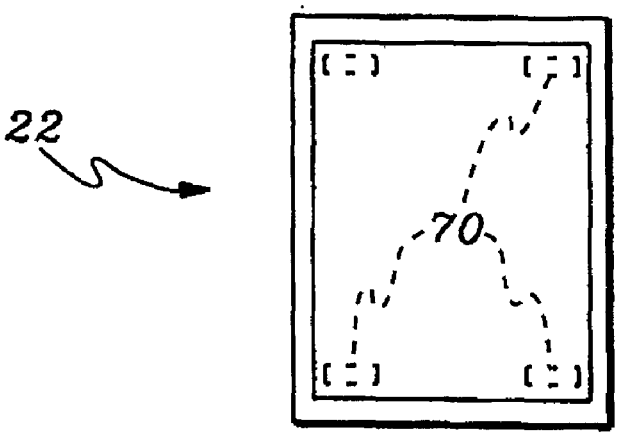
Figure 7:
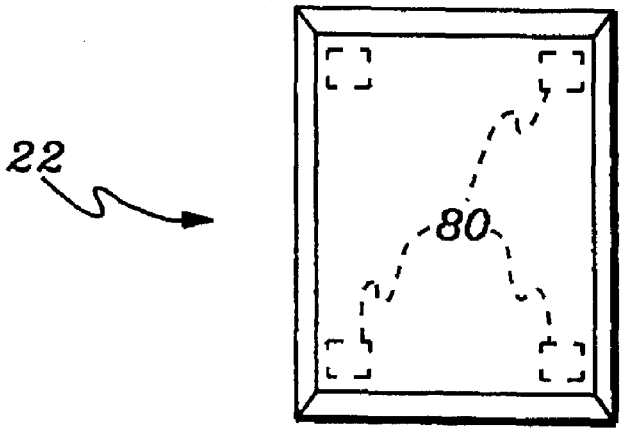
Figure 8:
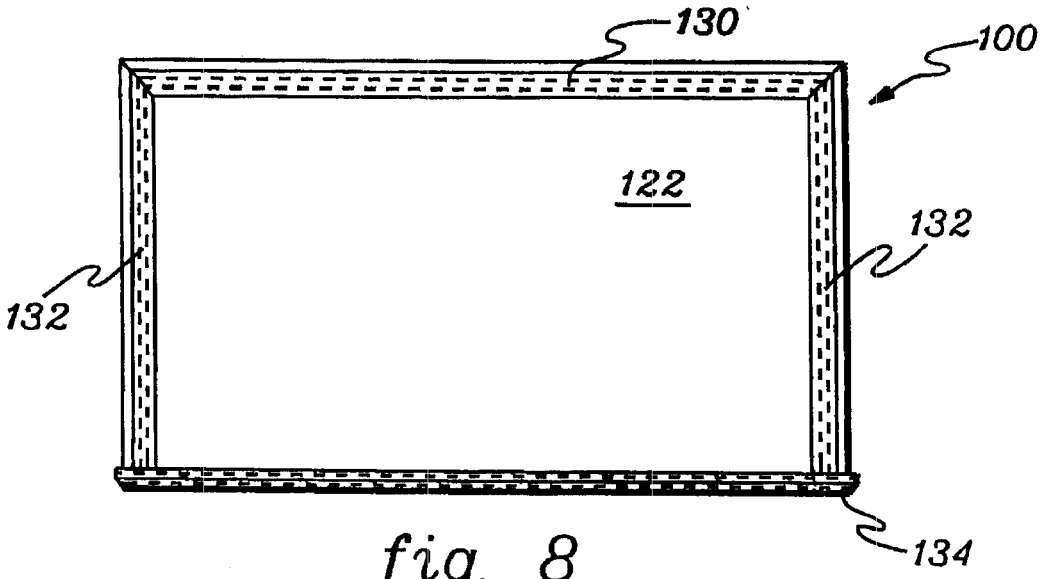
Figure 9:
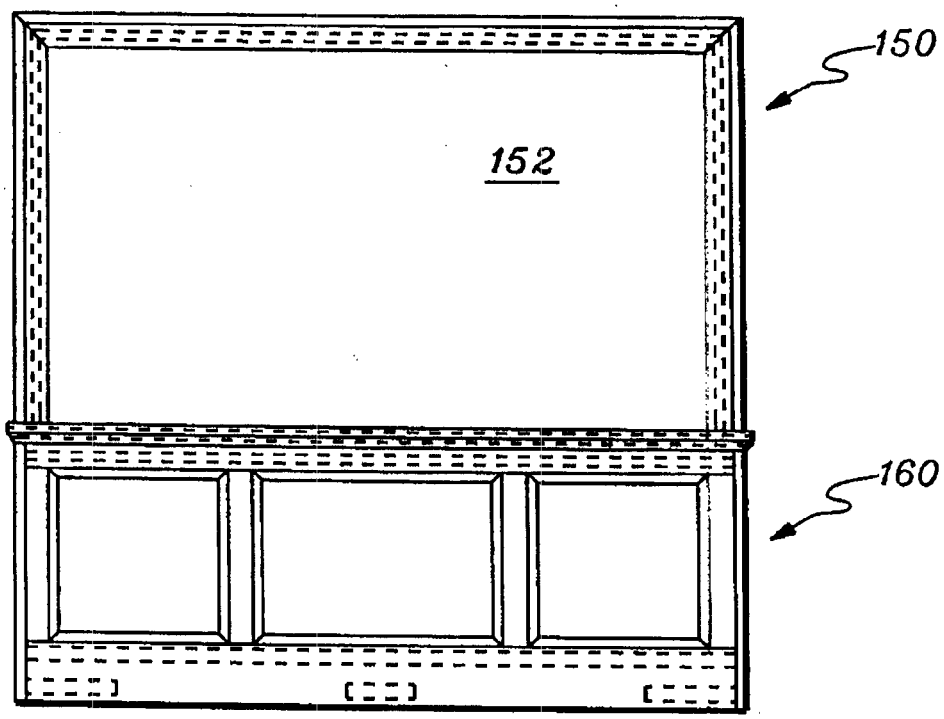
Figure 10:
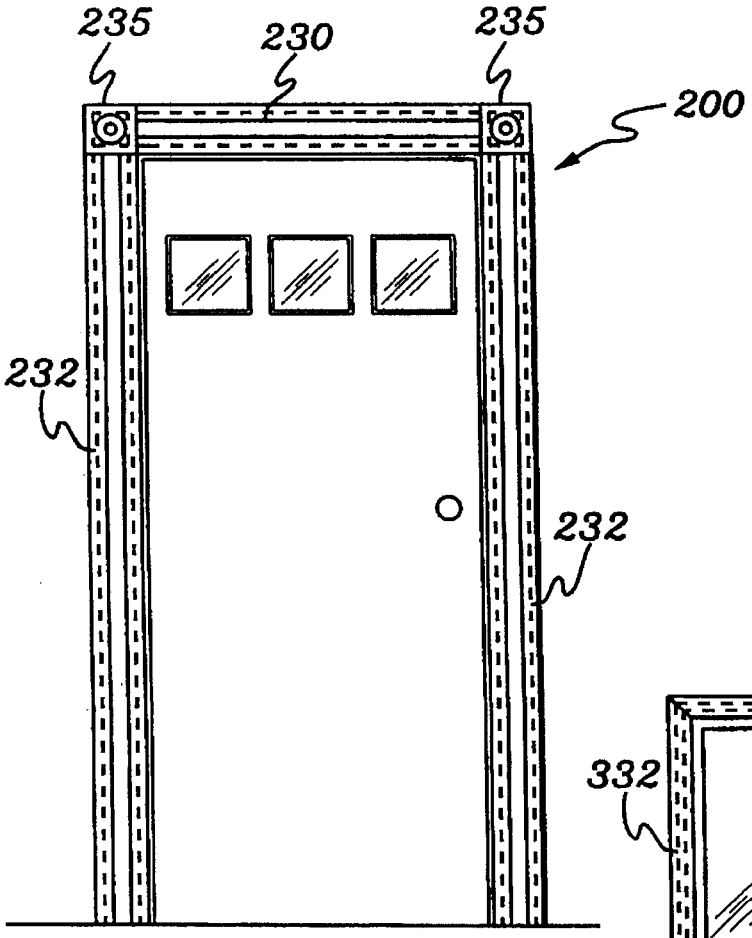
Figure 11:
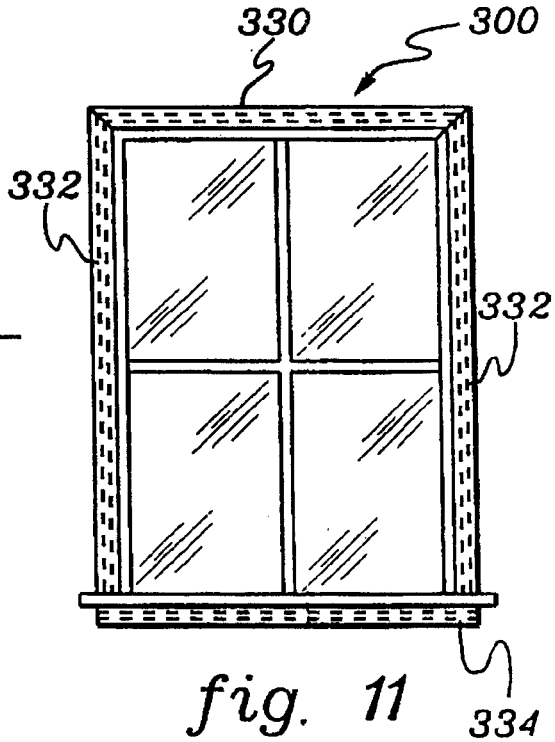
Figure 12:
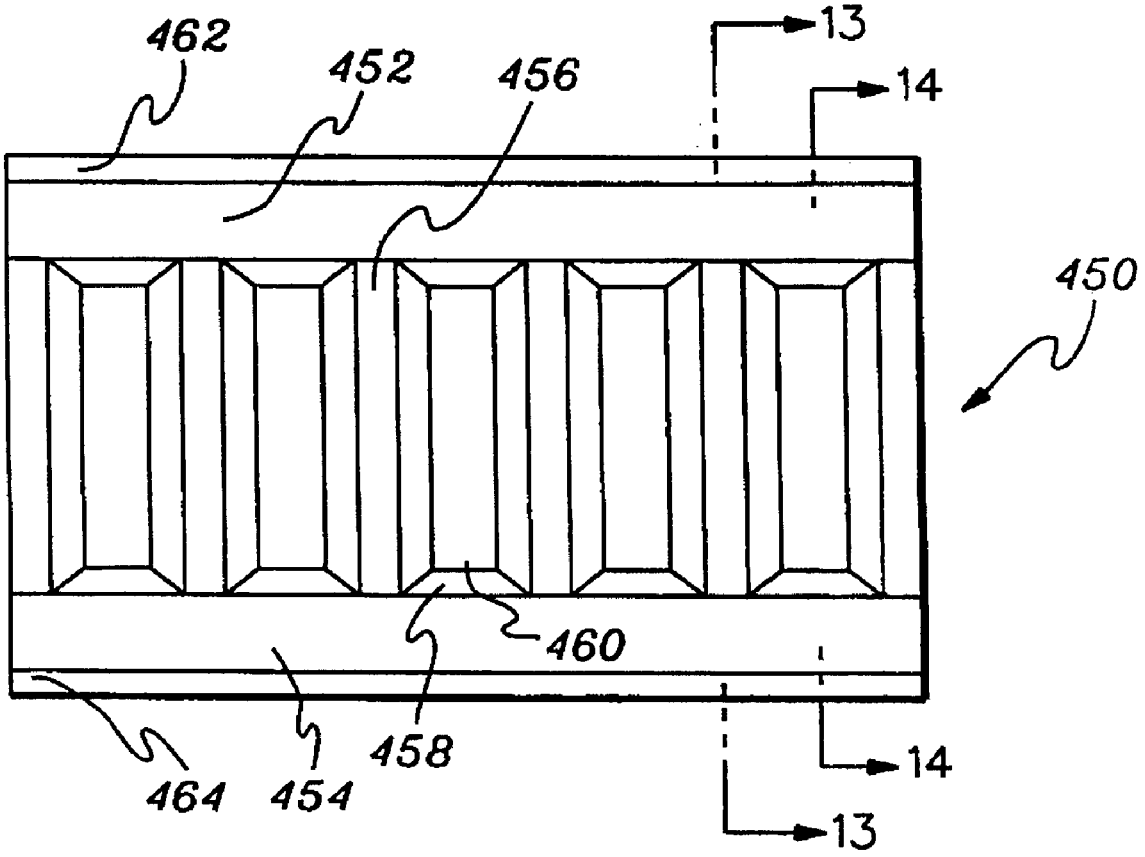
Figure 13:
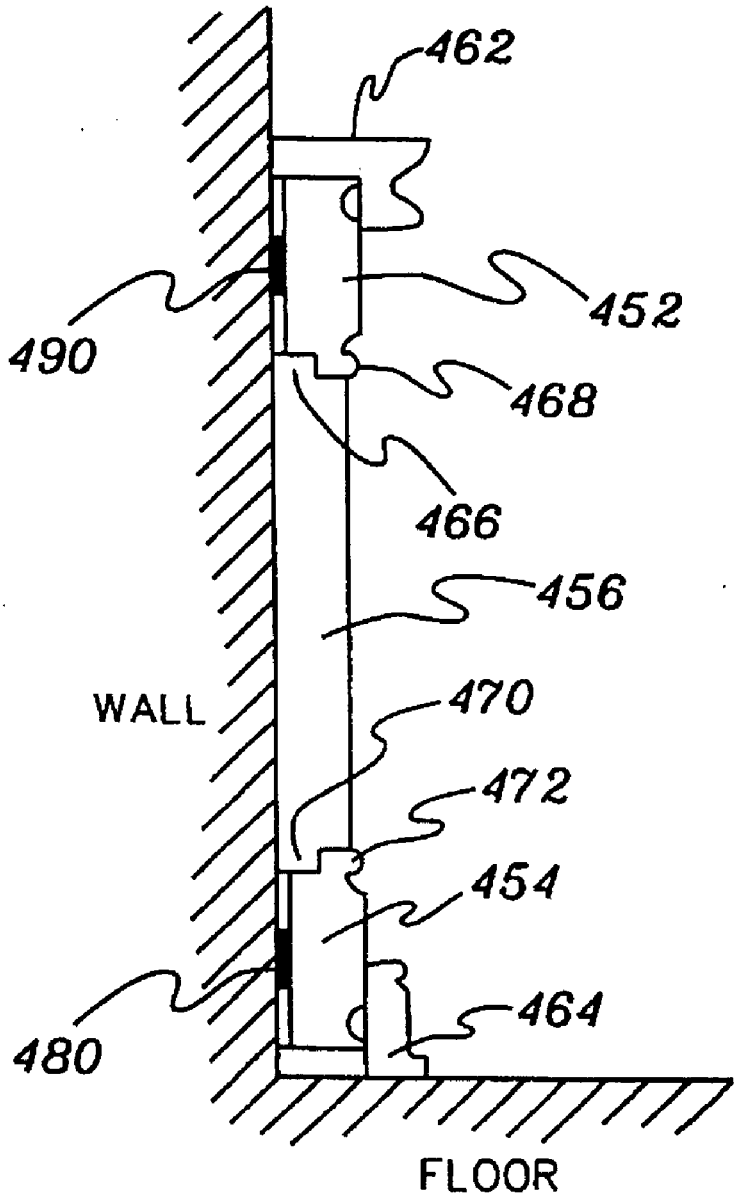
Figure 14:
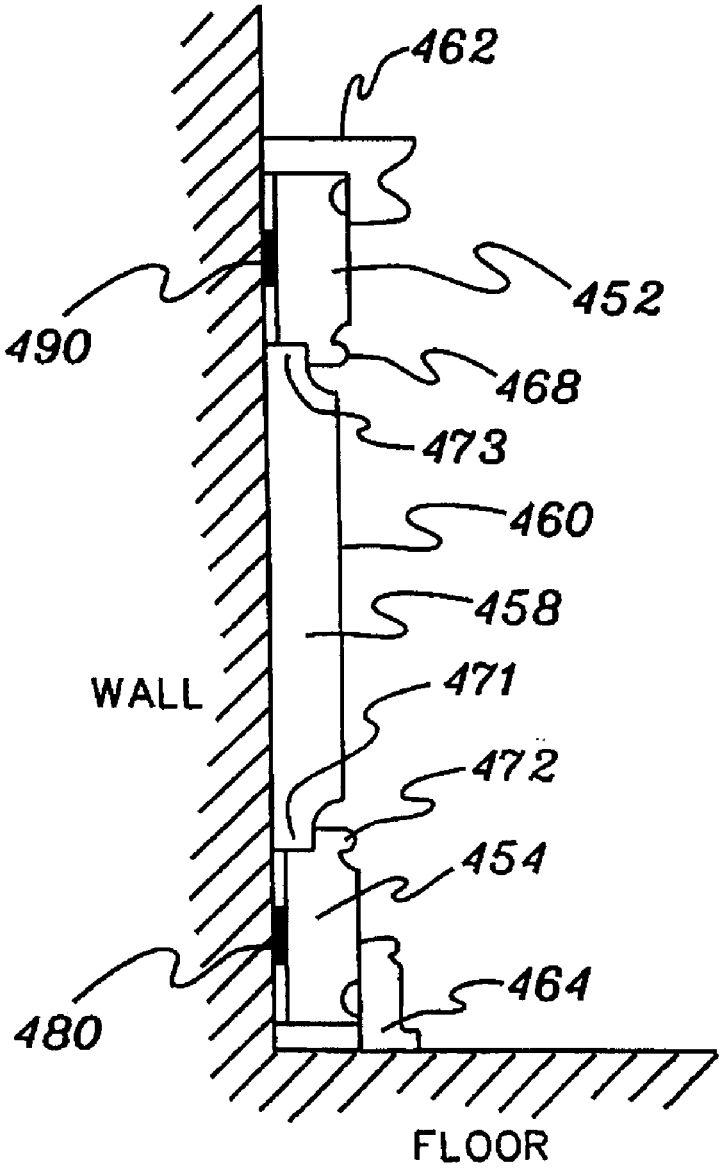
Figure 15:
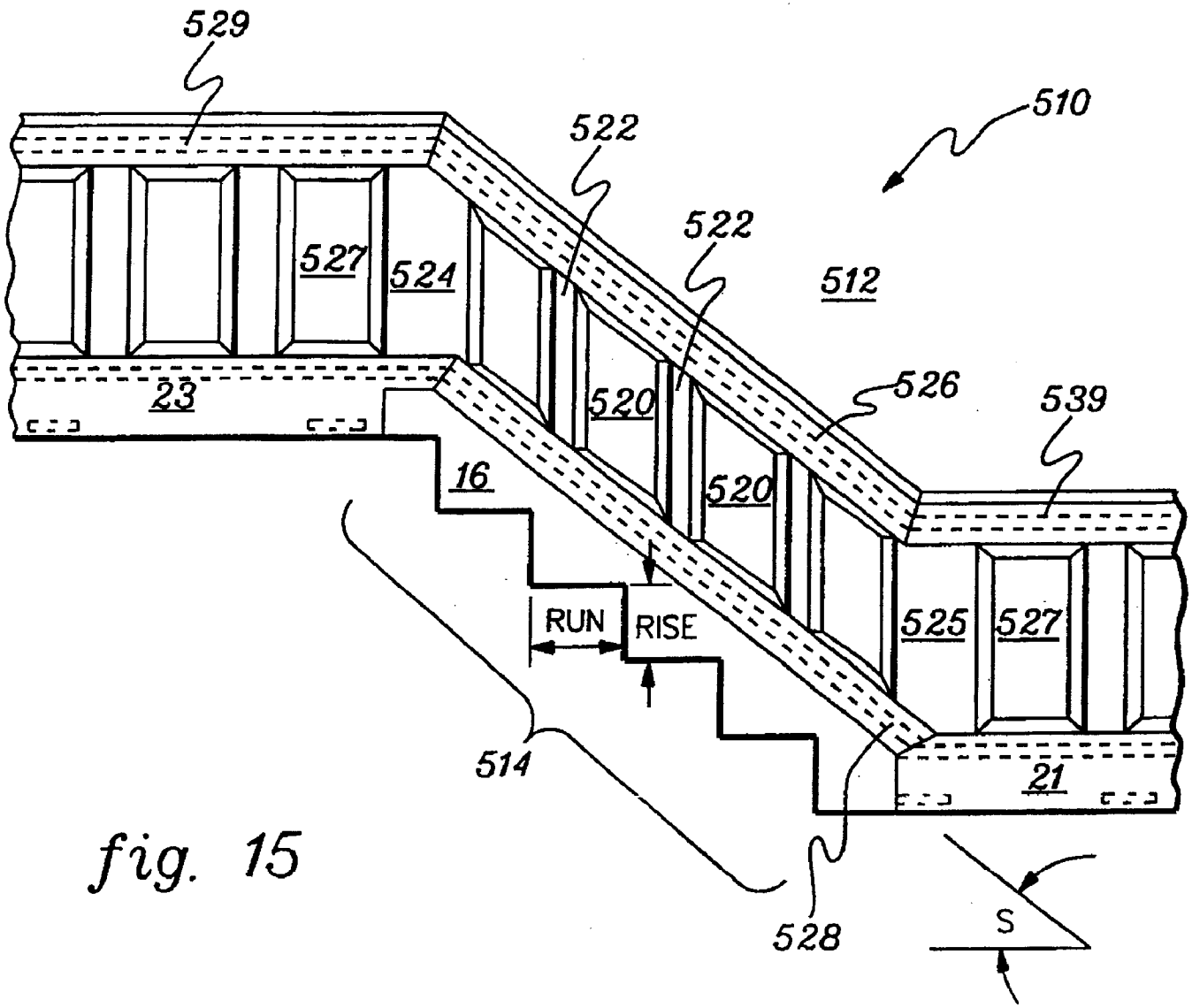
Figure 16:
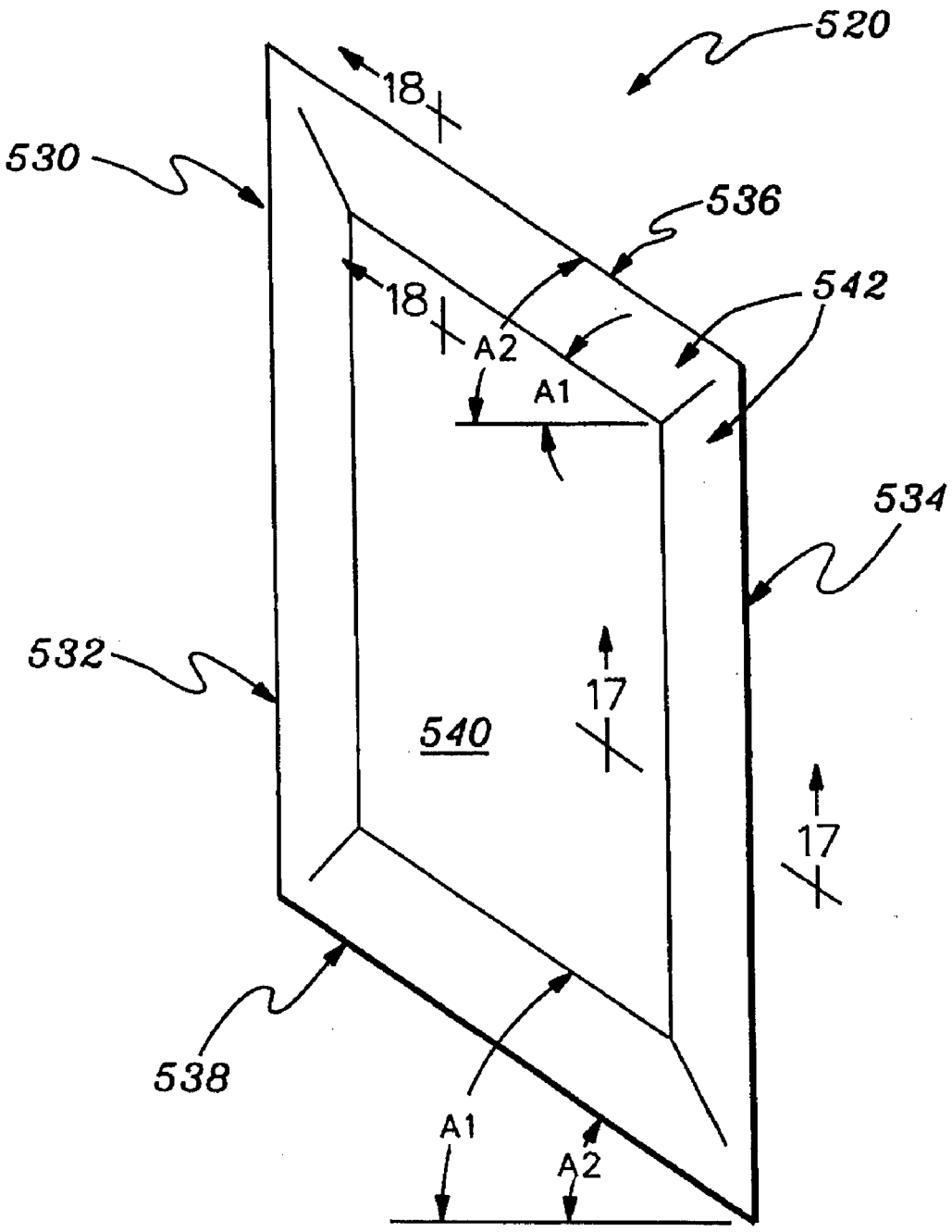
Figure 17:
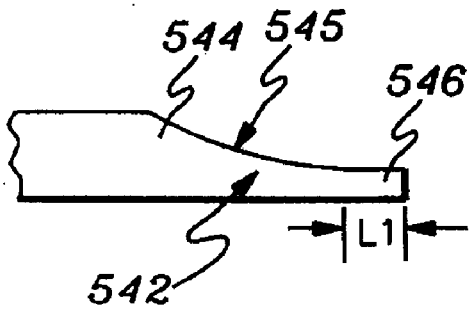
Figure 18:
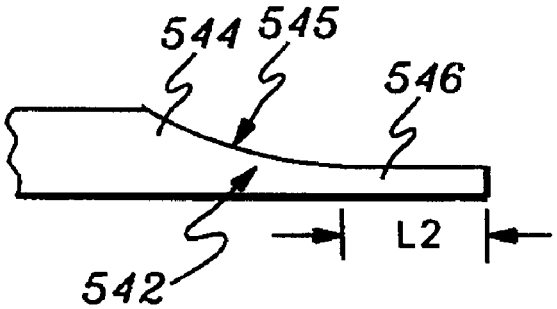
Figure 19:
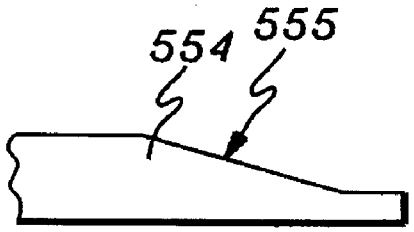
Figure 20:
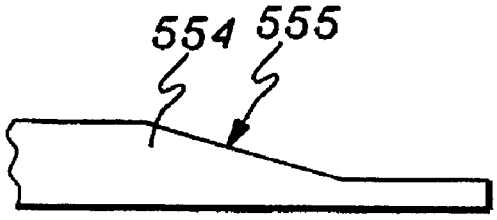
Figure 21:
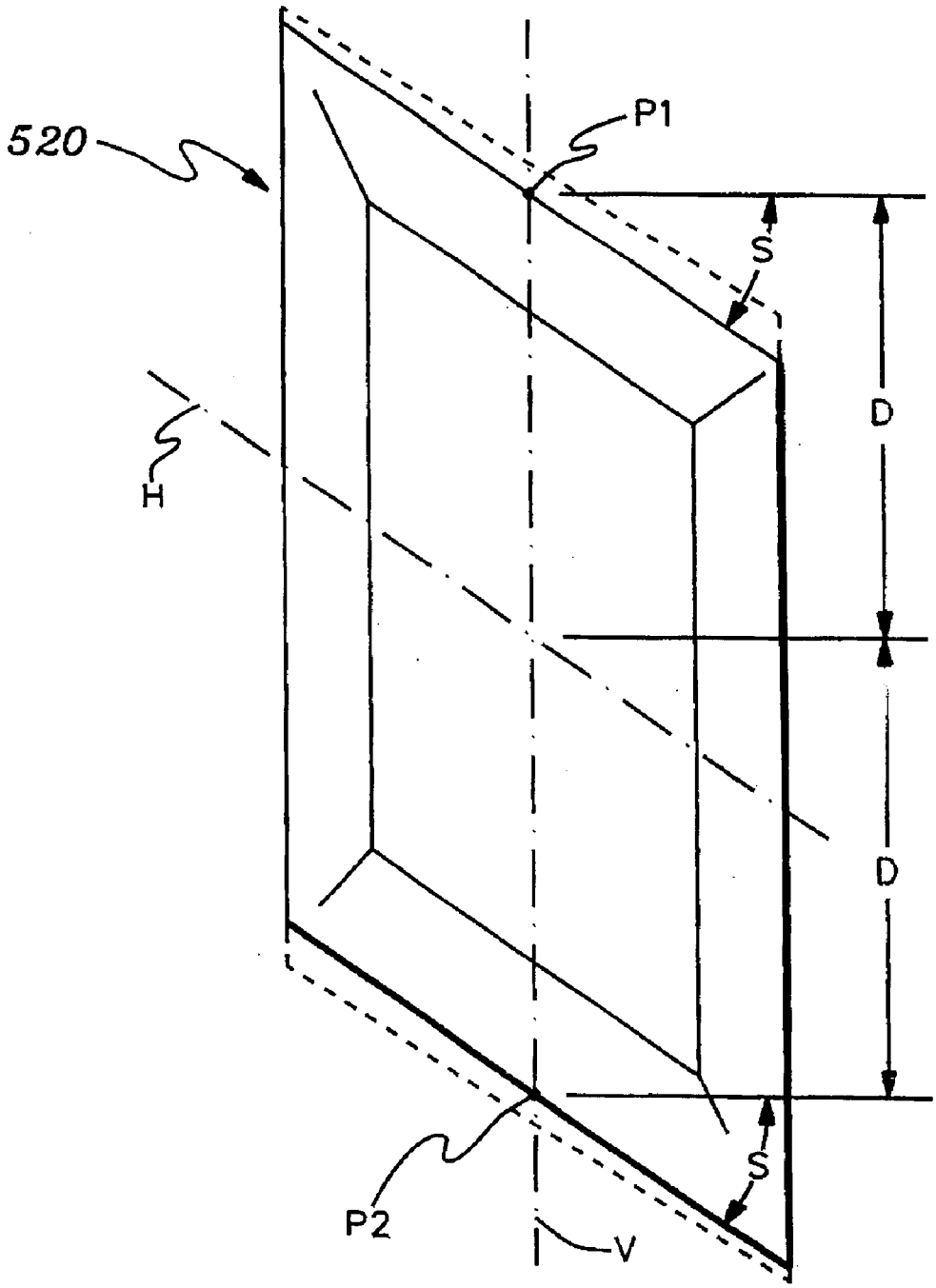
Figure 22:
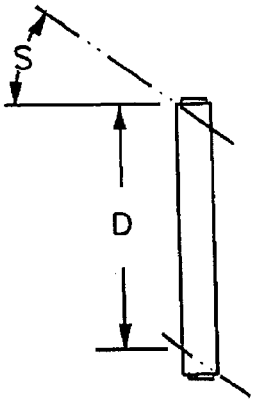
Figure 23:
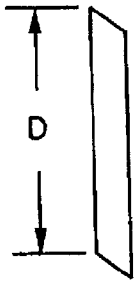
Figure 24:
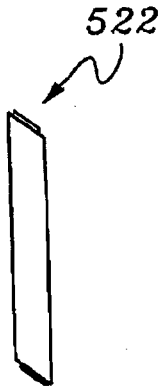
Figure 25:
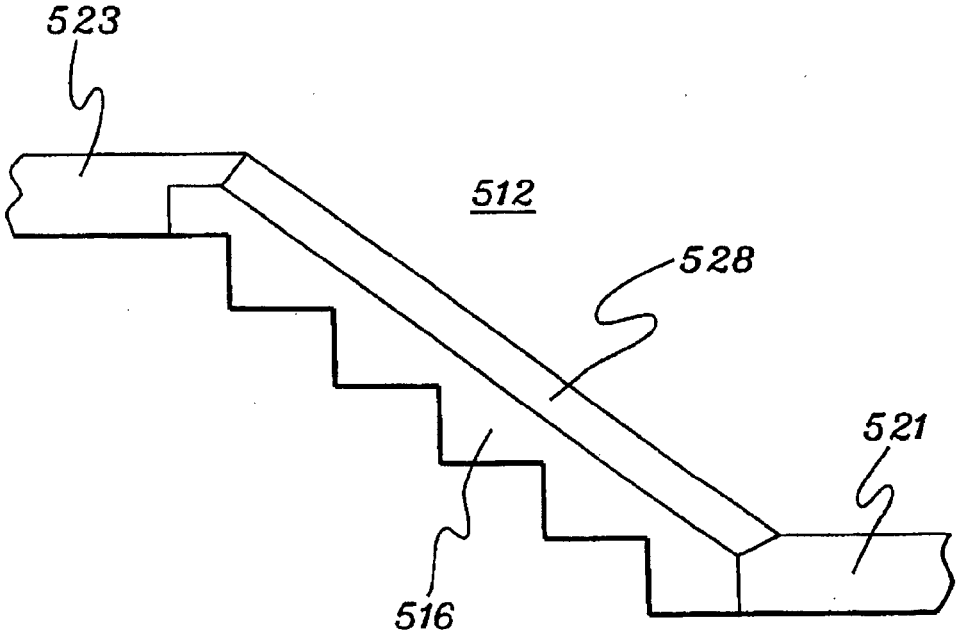
Figure 26:
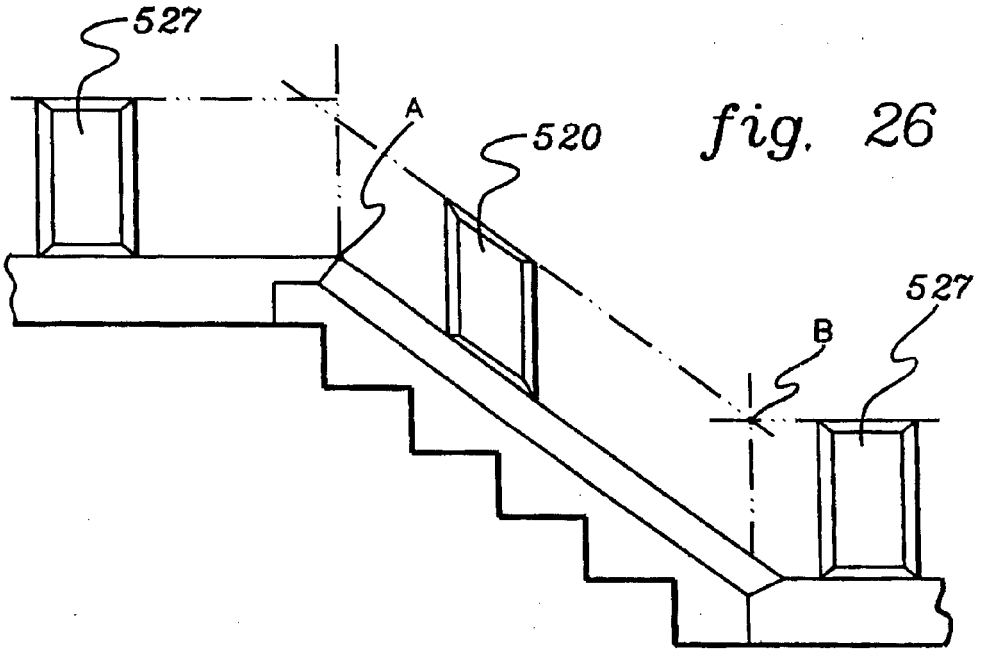
Figure 27:
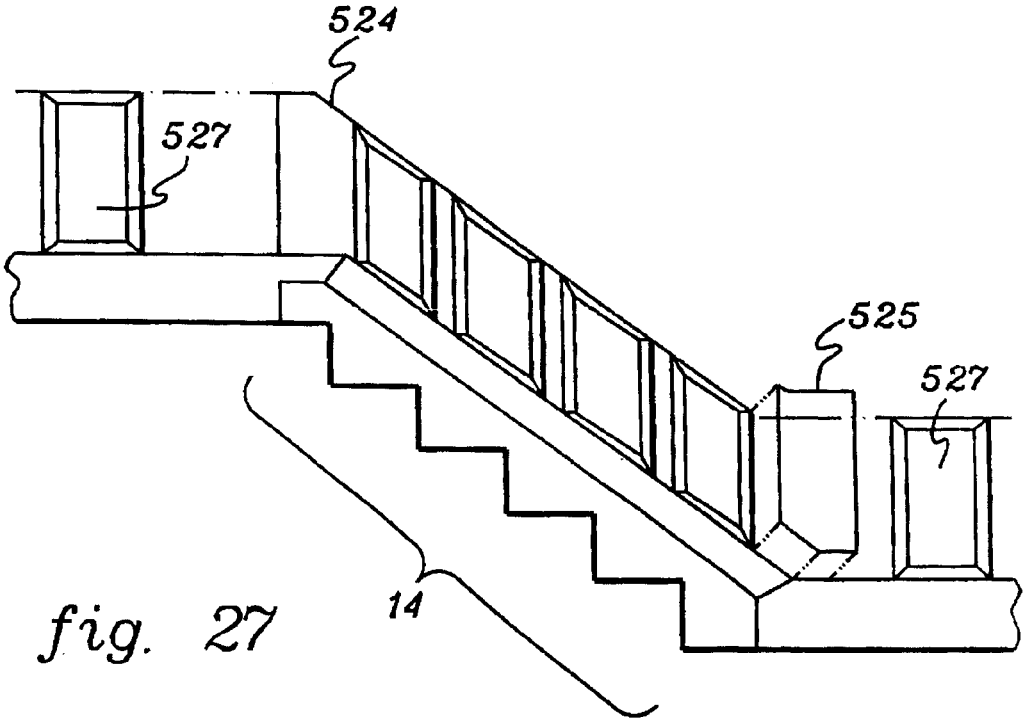

As shown in FIG. 27, at the top and the bottom of flight of stairs 514, top and bottom stiles 524 and 525, respectively, are marked and trimmed to make the transitions between rectangular-shaped raised panels 527 and trimmed adjustably sizable raised panels 520. After the top and bottom stiles are trimmed, dados are cut in the upper and lower ends thereof.

After placing all panels and stiles in position, top rails 526, 529, and 539 are slid into place as best shown in FIG. 15 and releasably attached to the wall with hook-and-loop fasteners. Desirably, chair rail caps are cut and fastened to the wall with hook-and-loop fasteners. In addition, desirably, the system includes interlocking joining or overlapping continuous grooves and tongues that sandwich the raised panels and stiles between the rails and the wall thereby enabling installation without coping.

From the present invention, it will be appreciated by those skilled in the art that the hook-and-loop fasteners may be applied to other locations on the rear surface of the various components than those described and illustrated in the figures.

The various components of the installed system are removable from the wall using a spatula-like or long blade putty knifelike device, slid between the hook and loop portions of the hook-and-loop fasteners. To reinstall the wall in another location, the portion to be attached to the wall must be installed at the new location. Desirably, a replacement kit, e.g., having the portion for attaching to the wall, may be provided by the manufacturer.

The various features of the various embodiments may be combined in still further embodiments and configurations. Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A kit releasably attachable to a wall, the kit comprising:

a plurality of elongated members;

at least one hook-and-loop fastener;

wherein some of said plurality of members are releasably attachable to the wall with said at least one hook-and-loop fastener to define at least one frame;

at least one panel, said elongated members being configured to extend over a peripherally-extending edge of said at least one panel; and at least one resilient shim positionable between the wall and a rear portion of said at least one panel.

2. The kit of claim 1 wherein said hook-and-loop fastener comprises a hook portion and a loop portion, and at least one of said hook portion and said loop portion being attached to a rear surface of some of said plurality of elongated members.

3. The kit of claim 2 wherein the other of said at least one of said hook portion and said loop portion having a backing having a layer of adhesive and a release cover sheet disposed on a surface of said layer of adhesive.

4. The kit of claim 1 wherein said hook-and-loop fastener comprises at least one roll, said at least one roll having a hook portion and a loop portion, said hook portion having a backing having a layer of adhesive and a release cover sheet disposed on a surface of said layer of adhesive, and said loop portion having a backing having a layer of adhesive and a release cover sheet disposed on a surface of said layer of adhesive.

5. The kit of claim 1 wherein said at least one hook-and-loop fastener comprises at least one of a hook portion and a loop portion, and at least one of said hook portion and said loop portion being attached to a rear portion of said at least one panel.

6. The kit of claim 1 wherein said at least one panel comprises at least one of a cork board, a chalkboard, and a presentation board.

7. The kit of claim 1 wherein said at least one panel comprises a plurality of panels, and wherein said elongated members comprise an upper rail, a bottom rail, and a plurality of stiles, and wherein portions of said upper rail, said bottom rail, and said plurality of stiles are configured to extend over a peripherally-extending edge of said plurality of panels.

8. The kit of claim 7 further comprising a plurality of side caps.

9. A kit releasably attachable to a wall, the kit comprising:

a plurality of elongated members;

at least one hook-and-loop fastener;

some of said plurality of members being releasably attachable to the wall with said at least one hook-and-loop fastener to define at least one frame; and wherein said elongated members comprise an upper rail having an upper L-shaped groove, a bottom rail having a lower L-shaped groove, and a plurality of stiles having an upper tongue, a lower tongue, and side L-shaped grooves, and wherein said upper tongue is sandwichable directly between a surface of said upper L-shaped groove and the wall, and the lower tongue is sandwichable directly between a surface of said lower L-shaped groove and the wall.

10. The kit of claim 9 further comprising a plurality of panels having a tongue at an edge of said plurality of panels, and wherein said tongue of said plurality of panels is sandwichable between a surface of said upper L-shaped groove of said upper rail, a surface of said lower L-shaped groove of said bottom rail, and a surface of said side L-shaped grooves of said stiles.

11. The kit of claim 10 wherein said at least one hook-and-loop fastener comprises a hook portion and a loop portion, and at least one of said hook portion and said loop portion being attached to a rear surface of said upper rail, and said bottom rail, and the other of said at least one of said hook portion and said loop portion having a backing having a layer of adhesive and a release cover sheet disposed on a surface of said layer of adhesive.

12. The kit of claim 11 wherein at least one of said hook portion and said loop portion being attached to a rear surface of said panels, and the other of said at least one of said hook portion and said loop portion having a backing having a layer of adhesive and a release cover sheet disposed on a surface of said layer of adhesive.

13. The kit of claim 11 further comprising a plurality of resilient shims positionable between the wall and a rear portion of said at least one panel.

14. A kit releasably attachable to a wall, the kit comprising:

a plurality of elongated members;

at least one hook-and-loop fastener;

wherein some of said plurality of members being releasably attachable to the wall with said at least one hook-and-loop fastener to define at least one frame; and a plurality of adjustably sizeable panels releasably attachable along a flight of stairs, said plurality of elongated members comprising an upper rail, a bottom rail, and a plurality of stiles, and wherein said plurality of adjustably sizeable panels comprise:

a parallelogram-shaped member having a pair of vertically-extending sides, and generally parallel angled top and bottom sides;

said parallelogram-shaped member having an outer frame having a relieved portion and a peripherally-extending portion;

said peripherally-extending portion of said pair of vertically-extending sides comprising a first length and said peripherally-extending portion of said top and said bottom sides comprising a second length; and wherein said second length is greater than said first length.

15. The kit of claim 14 wherein said relieved portion of said top and bottom sides is disposed on an angle of between about 37 degrees and about 41 degrees from horizontal.

16. The kit of claim 14 wherein said second length is between about ¼ inch and ¾ inch greater than said first length.

17. The kit of claim 14 wherein said upper rail comprises an upper L-shaped groove, said bottom rail comprises a lower L-shaped groove, and said a plurality of stiles comprise an upper tongue, a lower tongue, and side L-shaped grooves, and wherein said upper tongue is sandwichable directly between a surface of said upper L-shaped groove and the wall, and the lower tongue is sandwichable directly between a surface of said lower L-shaped groove and the wall.

18. The kit of claim 17 wherein said plurality of adjustably sizeable raised panels comprises a tongue at an edge of said plurality of adjustably sizeable raised panels, and wherein said tongue of said plurality of adjustably sizeable raised panels is sandwichable between a surface of said upper L-shaped groove of said upper rail, a surface of said lower L-shaped groove of said bottom rail, and a surface of said side L-shaped grooves of said stiles.

19. The kit of claim 14 wherein said hook-and-loop fastener comprises a hook portion and a loop portion, and at least one of said hook portion and said loop portion being attached to a rear surface of said upper rail, and said bottom rail, and the other of said at least one of said hook portion and said loop portion having a backing having a layer of adhesive and a release cover sheet disposed on a surface of said layer of adhesive.

20. A system releasably attachable to a wall, said system comprising:

a plurality of elongated members;

means for releasably attaching said plurality of elongated members to the wall to define at least one frame;

at least one panel, said elongated members being configured to extend over a peripherally-extending edge of said at least one panel; and at least one resilient shim positionable between the wall and a rear portion of said at least one panel.

21. The system of claim 20 wherein said means for releasably attaching comprises a plurality of hook-and-loop fasteners comprising a hook portion and a loop portion, and at least one of said hook portion and said loop portion being attached to a rear surface of some of said plurality of elongated members and the other of said at least one of said hook portion and said loop portion being attached to the wall.

22. The system of claim 20 wherein said means for releasably attaching comprises at least one hook-and-loop fastener comprising a hook portion and a loop portion, and at least one of said hook portion and said loop portion being attached to a rear surface of said panel and the other of said at least one of said hook portion and said loop portion being attached to the wall.

23. The system of claim 20 wherein said at least one panel comprises at least one of a cork board, a chalkboard, and a presentation board.

24. The system of claim 20 wherein said at least one panel comprises a plurality of panels, and wherein said elongated members comprise an upper rail, a bottom rail, and a plurality of stiles, and wherein portions of said upper rail, said bottom rail, and said plurality of stiles are configured to extend over a peripherally-extending edge of said plurality of panels.

25. The system of claim 24 further comprising a plurality of side caps.

26. A system releasably attachable to a wall, said system comprising:

a plurality of elongated members;

means for releasably attaching said plurality of elongated members to the wall to define at least one frame; and wherein said elongated members comprise an upper rail having an upper L-shaped groove, a bottom rail having a lower L-shaped groove, and a plurality of stiles having an upper tongue, a lower tongue, and side L-shaped grooves, and wherein said upper tongue is sandwiched directly between a surface of said upper L-shaped groove and the wall, and the lower tongue is sandwiched directly between a surface of said lower L-shaped groove and the wall.

27. The system of claim 26 further comprising a plurality of panels having a tongue at an edge of said plurality of panels, and wherein said tongue of said plurality of panels is sandwiched between a surface of said upper L-shaped groove of said upper rail, a surface of said lower L-shaped groove of said bottom rail, and a surface of said side L-shaped grooves of said stiles.

28. The system of claim 27 wherein said means for releasably attaching comprises at least one hook-and-loop fastener having a hook portion and a loop portion, and at least one of said hook portion and said loop portion being attached to a rear surface of said upper rail, and said bottom rail, and the other of said at least one of said hook portion and said loop portion being attached to the wall.

29. The system of claim 28 wherein at least one of said hook portion and said loop portion being attached to a rear surface of said panels, and the other of said at least one of said hook portion and said loop portion being attached to the wall.

30. The system of claim 28 further comprising a plurality of resilient shims positionable between the wall and a rear portion of said at least one panel.

31. A system releasably attachable to a wall, said system comprising:

a plurality of elongated members;

means for releasably attaching said plurality of elongated members to the wall to define at least one frame; and a plurality of adjustably sizeable raised panels releasably attachable along a flight of stairs, said plurality of elongated members comprising an upper rail, a bottom rail, and a plurality of stiles, and wherein said plurality of adjustably sizeable raised panels comprise:

a parallelogram-shaped member having a pair of vertically-extending sides, and generally parallel angled top and bottom sides;

said parallelogram-shaped member having an outer frame having a relieved portion and a peripherally-extending portion;

said peripherally-extending portion of said pair of vertically-extending sides comprising a first length and said peripherally-extending portion of said top and said bottom sides comprising a second length; and wherein said second length is greater than said first length.

32. The system of claim 31 wherein said relieved portion of said top and bottom sides is disposed on an angle of between about 37 degrees and about 41 degrees from horizontal.

33. The system of claim 31 wherein said second length is between about ¼ inch and ¾ inch greater than said first length.

34. The system of claim 31 wherein said upper rail comprises an upper L-shaped groove, said bottom rail comprises a lower L-shaped groove, and said a plurality of stiles comprise an upper tongue, a lower tongue, and side L-shaped grooves, and wherein said upper tongue is sandwiched directly between a surface of said upper L-shaped groove and the wall, and the lower tongue is sandwiched directly between a surface of said lower L-shaped groove and the wall.

35. The system of claim 34 wherein said plurality of adjustably sizeable raised panels comprises a tongue at an edge of said plurality of adjustably sizeable raised panels, and wherein said tongue of said plurality of adjustably sizeable raised panels is sandwiched between a surface of said upper L-shaped groove of said upper rail, a surface of said lower L-shaped groove of said bottom rail, and a surface of said side L-shaped grooves of said stiles.

36. The system of claim 31 wherein said hook-and-loop fastener comprises a hook portion and a loop portion, and at least one of said hook portion and said loop portion being attached to a rear surface of said upper rail, and said bottom rail, and the other of said at least one of said hook portion and said loop portion having a backing having a layer of adhesive and a release cover sheet disposed on a surface of said layer of adhesive.

37. A method for decorating at least a portion of a wall, the method comprising:

releasably attaching a plurality of elongated members to the wall to define at least one frame;

supporting at least one panel in the at least one frame; and positioning resilient shims between the rear surface of the plurality of panels and the wall.

38. The method of claim 37 wherein the releasably attaching comprises releasably attaching some of the elongated members to the wall with hook-and loop fasteners.

39. The method of claim 38 wherein the releasably attaching comprises releasably attaching a portion of a hook-and loop fastener to a surface of the wall.

40. The method of claim 37 wherein the at least one panel comprises at least one of a cork board, a chalkboard, and a presentation board.

41. The method of claim 37 wherein the plurality of elongated members comprise an upper rail, a bottom rail, and a plurality of stiles, and the at least one panel comprises a plurality of panels.

42. The method of claim 41 further comprising a plurality of side caps.

43. A releasably attachable panel kit attachable to a wall, the kit comprising:

a plurality of panels;

a plurality of stiles;

an upper rail having at least one first portion of a hook-and-loop fastener attached to a rear surface;

a bottom rail having at least one first portion of a hook-and-loop fastener attached to a rear surface;

at least one second portion of a hook-and-loop fastener attachable to the wall; and wherein said upper rail and said bottom rail are releasably attachable to the wall with said hook-and-loop fasteners and operable to support said plurality of stiles and panels therebetween against the wall.

44. The kit of claim 43 wherein said plurality of panels comprises a plurality of raised panels.

45. The kit of claim 43 wherein at least one second portion of a hook-and-loop fastener comprising a backing having a layer of adhesive and a release cover sheet disposed on a surface of said layer of adhesive.

46. The kit of claim 43 wherein said second portion of a hook-and-loop fastener comprises at least one roll, said second portion having a backing having a layer of adhesive and a release cover sheet disposed on a surface of said layer of adhesive.

47. The kit of claim 43 further comprising a plurality of side caps wherein said plurality of side caps are releasably attachable to the wall with said hook-and-loop fasteners.

48. A panel system releasably attachable to a wall, said system comprising:

an upper rail, a bottom rail, a plurality of stiles, and a plurality of panels disposed between said upper rail, said bottom rail, and said plurality of stiles; and a plurality of hook-and-loop fasteners; and wherein said upper rail and said bottom rail are releasably attachable to the wall with said hook-and-loop fasteners and operable to support said plurality of stiles and panels therebetween against the wall.

49. The system of claim 48 wherein said plurality of hook-and-loop fasteners extend over only a portion of rear surfaces of said upper rail and said bottom rail.

50. The system of claim 48 wherein said plurality of hook-and-loop fasteners comprises a strip extending over only a portion of rear surfaces of said upper rail and said bottom rail.

51. The system of claim 48 wherein portions of said upper rail, said bottom rail, and said plurality of stiles are configured to extend over a peripherally-extending edge of said plurality of panels.

52. The system of claim 48 wherein said plurality of panels comprises a plurality of raised panels.

53. The system of claim 48 comprising a plurality of side caps wherein said plurality of side caps are releasably attached to the wall with said hook-and-loop fasteners.

54. A method for decorating at least a portion of a wall, the method comprising:

releasably attaching a bottom rail to the wall with at least one hook-and loop fastener;

releasably attaching an upper rail to the wall with at least one hook-and loop fastener; and supporting a plurality of stiles and a plurality of panels disposed between the upper rail and the bottom rail.

55. The method of claim 54 further comprising attaching a portion of the at least one hook-and-loop fastener to a surface of the wall corresponding to the bottom rail.

56. The method of claim 55 wherein the portion of the at least one hook-and-loop fastener comprises an elongated hook-and-loop fastener strip corresponding to the length of the bottom rail.

57. The method of claim 54 wherein the attaching comprises removing a release sheet from the elongated hook-and-loop fastener strip to expose an adhesive layer.

58. The method of claim 54 further comprising attaching a portion of the at least one hook-and-loop fastener to a surface of the wall corresponding to the upper rail.

59. The method of claim 58 wherein the portion of the at least one hook-and loop fastener comprises an elongated hook-and-loop fastener strip corresponding to the length of the upper rail.

60. The method of claim 51 wherein the attaching comprises removing a release sheet from the elongated hook-and-loop fastener strip to expose an adhesive layer.

61. The method of claim 54 further comprising releasably attaching a plurality of side caps to the wall with hook-and-loop fasteners.

62. The method of claim 61 further comprising attaching a portion of the at least the hook-and-loop fasteners to a surface of the wall corresponding to the plurality of side caps.

63. The method of claim 54 further comprising attaching a portion of the hook-and-loop fastener to a surface of the wall corresponding to the bottom rail, attaching a portion of the hook-and-loop fastener to a surface of the wall corresponding to the upper rail, and attaching a portion of the hook-and-loop fastener to a surface of the wall corresponding to a plurality of side caps.

64. The method of claim 54 wherein said plurality of panels comprises a plurality of raised panels.

* * * * *

UNITED STATES PATENT AND TRADEMARK OFFICE

CERTIFICATE OF CORRECTION

PATENT NO. : 6,751,915 B2
DATED : June 22, 2004
INVENTOR(S) : John S. Crowley

It is certified that error appears in the above-identified patent and that said Letters Patent is hereby corrected as shown below:

Delete the Title page and substitute therefor the attached title page.

Delete Drawing Sheets 1-14 and substitute therefor the attached drawing sheets 1-14.

Column 1,
Lines 10 and 11, delete the words “now abandoned” after “1997”.

Column 14,
Line 65, delete “51” and insert -- 59 --.

Signed and Sealed this

Twenty-second Day of November, 2005

JON W. DUDAS
*Director of the United States Patent and Trademark Office*

(12) United States Patent
Crowley

(10) Patent No.: US 6,751,915 B2
(45) **Date of Patent: *Jun. 22, 2004**

(54) KITS AND SYSTEMS RELEASABLY ATTACHABLE TO A WALL, AND METHODS EMPLOYING SAME

(75) Inventor: John S. Crowley, Falmouth, ME (US)

(73) Assignee: New England Classic Interiors, Inc., South Portland, ME (US)

( * ) Notice: Subject to any disclaimer, the term of this patent is extended or adjusted under 35 U.S.C. 154(b) by 52 days.

This patent is subject to a terminal disclaimer.

(21) Appl. No.: 10/058,982

(22) Filed: Jan. 28, 2002

(65) Prior Publication Data

US 2002/0166303 A1 Nov. 14, 2002

Related U.S. Application Data

(63) Continuation-in-part of application No. 09/640,980, filed on Aug. 17, 2000, now Pat. No. 6,341,461, which is a continuation of application No. 08/781,056, filed on Jan. 9, 1997, now abandoned, application No. 10/058,982, which is a continuation-in-part of application No. 09/605,251, filed on Jun. 18, 2000, now Pat. No. 6,374,562.

(51) Int. Cl.[7] ..... E04B 2/00; E04B 2/08; E04F 13/10

(52) U.S. Cl. ..... 52/311.2; 52/506.05; 52/DIG. 13; 52/211; 52/717.01; 52/718.01; 52/313; 52/511

(58) Field of Search ..... 52/DIG. 13, 506.05, 52/287.1, 288.1, 211, 204.53, 717.01, 718.01, 313, 511, 716.1, 311.2, 579

(56) References Cited

U.S. PATENT DOCUMENTS

| | | | | | |
|---|---|---|---|---|---|
| 741,524 | A | | 10/1903 | Miller | |
| 2,594,928 | A | | 4/1952 | Horowitz | 20/4 |
| 3,616,120 | A | | 10/1971 | Warwick | 428/81 |
| 3,668,808 | A | * | 6/1972 | Perina | |
| 3,745,709 | A | * | 7/1973 | Perina | |
| 3,863,412 | A | * | 2/1975 | Bodycomb et al. | 52/483.1 |
| 3,981,112 | A | | 9/1976 | Dake | 52/184 |
| 4,041,667 | A | * | 8/1977 | Lindner et al. | |
| 4,271,566 | A | * | 6/1981 | Perina | |
| 4,557,096 | A | | 12/1985 | Hovde | 52/595 |
| 4,724,638 | A | | 2/1988 | Bezborodko | 52/311 |
| 4,736,559 | A | | 4/1988 | Young | 52/313 |

(List continued on next page.)

FOREIGN PATENT DOCUMENTS

| | | | |
|---|---|---|---|
| CH | 134020 | 11/1929 | 52/506.01 |
| DE | 100 58 853 A1 * | 5/2002 | E04F/13/08 |

OTHER PUBLICATIONS

Stair–Pak, Panel–Pak Wainscoting, Stair–Pak Products Co., Inc., Sold Since 1989, 4 pages.

(List continued on next page.)

*Primary Examiner*—Robert Canfield
(74) *Attorney, Agent, or Firm*—Heslin Rothenberg Farley & Mesiti P.C.

(57) ABSTRACT

A kit releasably attachable to a wall includes a plurality of elongated members, and at least one hook-and-loop fastener. The plurality of members are releasably attachable to the wall with the at least one hook-and-loop fastener to define at least one frame. For example, the kit may be elongated members for framing a door or a window. The kit may also include at least one panel to be framed such as a raised panel, a cork board, a chalkboard, and a presentation board. At least one resilient shim may be positionable between the wall and a rear portion of the at least one panel. In another embodiment, the kit includes an upper rail, a bottom rail, a plurality of stiles, a plurality of raised panels, and at least one hook-and-loop fastener for releasably attaching the rails to the wall.

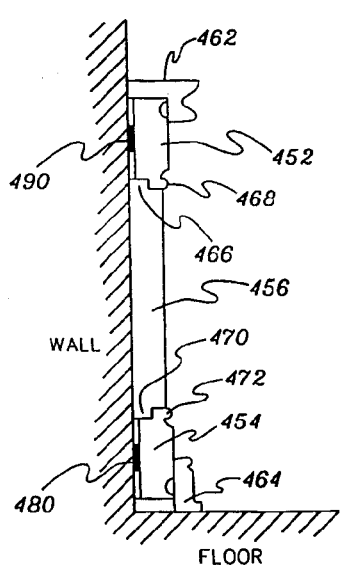

64 Claims, 14 Drawing Sheets